US009982512B2

(12) United States Patent
Getzlaf et al.

(10) Patent No.: US 9,982,512 B2
(45) Date of Patent: May 29, 2018

(54) APPARATUS AND METHOD FOR TREATING A RESERVOIR USING RE-CLOSEABLE SLEEVES

(71) Applicant: NCS MULTISTAGE INC., Calgary (CA)

(72) Inventors: Don Getzlaf, Calgary (CA); John Ravensbergen, Dewinton (CA)

(73) Assignee: NCS Multistage Inc., Calgary, Alberta ( * ) Notice: Subject to any disclaimer, the term of this patent is extended or adjusted under 35 U.S.C. 154(b) by 94 days.

(21) Appl. No.: 14/830,507

(22) Filed: Aug. 19, 2015

(65) Prior Publication Data

US 2016/0076335 A1 Mar. 17, 2016

Related U.S. Application Data

(60) Provisional application No. 62/039,058, filed on Aug. 19, 2014, provisional application No. 62/097,245, (Continued)

(51) Int. Cl.
*E21B 34/14* (2006.01)
*E21B 34/10* (2006.01)
(Continued)

(52) U.S. Cl.
CPC ..... *E21B 34/14* (2013.01); *E21B 34/10* (2013.01); *E21B 34/12* (2013.01); *E21B 43/16* (2013.01); *E21B 2034/007* (2013.01)

(58) Field of Classification Search
CPC .... E21B 2034/007; E21B 34/14; E21B 37/08; E21B 33/138
See application file for complete search history.

(56) References Cited

U.S. PATENT DOCUMENTS 4,749,044 A 6/1988 Skipper et al. ..... 166/323
4,949,788 A * 8/1990 Szarka ..... E21B 23/006 166/285
(Continued)

FOREIGN PATENT DOCUMENTS

EP 2295715 3/2011
WO WO 2001/02697 1/2001
(Continued)

OTHER PUBLICATIONS

International Search Report and Written Opinion issued in PCT/CA2015/000470, dated Nov. 10, 2015.

*Primary Examiner* — D. Andrews
*Assistant Examiner* — Jonathan Malikasim
(74) *Attorney, Agent, or Firm* — Ridout & Maybee LLP

(57) ABSTRACT

There is provided a flow control apparatus comprising: a housing; a port extending through the housing; a housing passage defined within the housing and configured for fluidly communicating via the port; a flow control member displaceable relative to the port for effecting opening and closing of the port; a retainer housing space, disposed between the housing and the flow control member, and co-operating with the flow control member such that, at least while the flow control member is disposed in the closed position, a sealing interface is disposed between the retainer housing space and the housing passage; and a resilient retainer member, extending from the housing and into the retainer housing space, and configured to releasably engage the flow control member for resisting displacement of the flow control member.

18 Claims, 21 Drawing Sheets

Related U.S. Application Data filed on Dec. 29, 2014, provisional application No. 62/095,859, filed on Dec. 23, 2014.

(51) Int. Cl.

| | |
|---|---|
| ***E21B 34/12*** | (2006.01) |
| ***E21B 43/16*** | (2006.01) |
| ***E21B 34/00*** | (2006.01) |

(56) References Cited

U.S. PATENT DOCUMENTS

| | | | | |
|---|---|---|---|---|
| 5,156,207 | A | 10/1992 | Haugen et al. | 166/142 |
| 5,263,683 | A | 11/1993 | Wong | 251/145 |
| 7,387,165 | B2 | 6/2008 | Lopez de Cardenas et al. | 166/313 |
| 7,748,463 | B2 * | 7/2010 | Revheim | E21B 33/14 166/332.4 |
| 7,870,907 | B2 * | 1/2011 | Lembcke | E21B 33/14 166/316 |
| 7,971,646 | B2 | 7/2011 | Murray et al. | 166/332.4 |
| 8,171,994 | B2 | 5/2012 | Murray et al. | 166/308.1 |
| 8,291,982 | B2 | 10/2012 | Murray et al. | 166/332.1 |
| 8,490,702 | B2 | 7/2013 | Stromquist et al. | 166/298 |
| 8,567,501 | B2 | 10/2013 | Zimmerman et al. | 166/307 |
| 2002/0070028 | A1 | 6/2002 | Garcia et al. | 166/373 |
| 2003/0019634 | A1 | 1/2003 | Henderson et al. | 166/373 |
| 2011/0042107 | A1 | 2/2011 | Chambers et al. | 166/386 |
| 2011/0048706 | A1 | 3/2011 | Clem et al. | 166/278 |
| 2011/0174491 | A1 | 7/2011 | Ravensbergen et al. | 166/308.1 |
| 2012/0067583 | A1 | 3/2012 | Zimmerman et al. | 166/308.1 |
| 2013/0133891 | A1 | 5/2013 | Getzlaf et al. | 166/308.1 |
| 2014/0048271 | A1 * | 2/2014 | Coon | E21B 34/102 166/308.1 |

FOREIGN PATENT DOCUMENTS

| | | |
|---|---|---|
| WO | WO 2007/084006 | 7/2007 |
| WO | WO 2012/149638 | 11/2012 |

* cited by examiner

APPARATUS AND METHOD FOR TREATING A RESERVOIR USING RE-CLOSEABLE SLEEVES

CROSS REFERENCE TO RELATED APPLICATIONS

This application claims the benefit of U.S. Provisional Applications No. 62/039,058 filed Aug. 19, 2014, No. 62/097,245 filed Dec. 29, 2014 and No. 62/095,859 filed Dec. 23, 2014. This application also claims the benefit of Canadian Application No. 2,859,813 filed Aug. 19, 2014. The entire contents of these disclosures are incorporated by reference.

FIELD

This disclosure relates to treatment material of a hydrocarbon-containing reservoir.

BACKGROUND

Closeable sleeves are useful to provide operational flexibility during fluid treatment of a hydrocarbon-containing reservoir. Existing forms of such closeable sleeve are overly complicated and include unnecessary components, and are prone to unnecessary mechanical stresses. Also, problems exist with closing these sleeves immediately after fluid treatment, owing to the existence of solid materials in the vicinity of the treatment material port.

SUMMARY

In one aspect, there is provided a flow control apparatus comprising: a housing; a port extending through the housing; a housing passage defined within the housing and configured for fluidly communicating via the port; a flow control member displaceable relative to the port for effecting opening and closing of the port; a retainer housing space, disposed between the housing and the flow control member, and co-operating with the flow control member such that, at least while the flow control member is disposed in the closed position, a sealing interface is disposed between the retainer housing space and the housing passage; and a resilient retainer member, extending from the housing and into the retainer housing space, and configured to releasably engage the flow control member for resisting displacement of the flow control member.

In another aspect, there is provided an apparatus configured for deployment within a wellbore for stimulating a subterranean formation through a port that is closable by a flow control member, comprising: a shifting tool configured, upon actuation, for engaging the flow control member, and for, while being engaged to the flow control member, effecting displacement of the flow control member from an open position to a closed position, for effecting closing of the port; and a washing sub including a nozzle configured to inject fluid into the wellbore, and positioned relative to the shifting tool, such that, while the apparatus is positioned within a wellbore such that, upon the actuation of the shifting tool, the engagement between the shifting tool and the flow control member is being effected, and while the flow control member is disposed in the open position, the nozzle is disposed for directing injected fluid towards the path along which the flow control member is disposed for travelling as the flow control member is displaced from the open position to the closed position.

In yet another aspect, there is provided a method of stimulating a formation within a wellbore that is lined with a wellbore string including a wellbore string passage, comprising: after having displaced a flow control member from a closed position to an open position, with effect that fluid communication becomes established, through a port, between the wellbore string passage and the subterranean formation, and after having supplied treatment material to the subterranean formation through the port, and then having suspended such supplying; directing a wash fluid to the space through which the flow control member is disposed for travelling as the flow control member is displaced from the open position to the closed position, such that solid material is fluidized.

In yet another aspect, there is provided a system for stimulating a formation within a wellbore, comprising: a wellbore string including: a flow control apparatus including: a housing; a port extending through the housing for effecting fluid communication between the wellbore and the subterranean formation; a flow control member displaceable relative to the port for effecting opening and closing of the port; a resilient retainer member, extending from the housing, and configured to releasably engage a recess of the flow control member for resisting displacement of the flow control member; wherein the resilient retainer member and the recess are co-operatively configured such that displacement of the resilient retainer member from the recess, with effect that the flow control member becomes disposed for displacement relative to the housing, is effected by a first displacement force, wherein the first displacement force is greater than a minimum first displacement force; and a downhole tool for deployment through the wellbore string, comprising: a shifting tool configured for effecting displacement of the flow control member; a resilient locator configured for engaging a locator-receiving recess within the wellbore string for locating the downhole tool and resisting movement of the downhole tool relative to the wellbore string; and wherein the resilient locator and the locator-receiving recess are co-operatively configured such that displacement of the resilient locator from the locator-receiving recess, with effect that the downhole tool becomes disposed for displacement relative to the wellbore string, is effected by a second displacement force, wherein the second displacement force is greater than a minimum second displacement force; wherein the minimum first displacement force is greater than the minimum second displacement force.

In yet still another aspect, there is provided a downhole tool configured for deployment within a wellbore through a wellbore string, wherein the wellbore string defines a wellbore string passage and includes: a locator-receiving recess; and a flow control apparatus including: a housing; a port extending through the housing for effecting fluid communication between the wellbore string passage and a subterranean formation; a flow control member displaceable relative to the port for effecting opening and closing of the port; a resilient retainer member, extending from the housing, and configured to releasably engage a recess of the flow control member for resisting displacement of the flow control member; wherein the resilient retainer member and the recess are co-operatively configured such that displacement of the resilient retainer member from the recess, with effect that the flow control member becomes disposed for movement relative to the wellbore string, is effected by a first displacement force, wherein the first displacement force is greater than a minimum first displacement force; wherein the downhole tool comprises: a shifting tool configured for effecting displacement of the flow control member; a resilient locator configured for engaging the locator-receiving recess for locating the downhole tool and resisting movement of the downhole tool relative to the wellbore string, and being configured, relative to the locator-receiving recess, such that displacement of the locator from the locator-receiving recess, with effect that the downhole tool becomes disposed for displacement relative to the wellbore string, is effected by a second displacement force, wherein the second displacement force is greater than a minimum second displacement force; wherein the minimum first displacement force is greater than the minimum second displacement force.

In yet still another aspect, there is provided a flow control apparatus configured for integration within a wellbore string disposed within a wellbore extending into a subterranean formation, comprising: a housing; a housing passage defined within the housing; first and second sealing members; a port extending through the housing and disposed between the first and second sealing members; a flow control member displaceable between a closed position and an open position, wherein, while integrated within a wellbore string disposed within a wellbore, in the closed position, the flow control member is sealing, or substantially sealing, fluid communication, via the port, and in the open position, fluid communication is effected, via the port, between the wellbore string and the subterranean formation; wherein the sealing, or substantial sealing, of fluid communication via the port, while the flow control member is disposed in the closed position, is effected by sealing engagement, or substantial sealing engagement, of the flow control member with the first and second sealing members; and wherein each one of the sealing members, independently, defines a respective fluid pressure responsive surface, with effect that while the flow control member is disposed in the closed position, and in sealing engagement, or substantial sealing engaement, with the sealing members, each one of the fluid pressure responsive surfaces, independently, is configured to receive application of fluid pressure from fluid disposed within the housing passage; and wherein the total surface area of one of the fluid pressure responsive surfaces is at least 90% of the total surface area of the other one of the fluid pressure responsive surfaces.

In yet still another aspect, there is provided a flow control apparatus comprising: a housing; a housing passage defined within the housing; a port extending through the housing; a flow control member displaceable, relative to the port, for effecting opening and closing of the port; a retainer housing space, disposed between the housing and the flow control member; a resilient retainer member, extending from the housing and into the retainer housing space, and configured to engage the flow control member for resisting displacement of the flow control member; and a viscous liquid material disposed within the retainer housing space, wherein the viscous liquid material has a viscosity of at least 100 mm2/s at 40 degrees Celsius

BRIEF DESCRIPTION OF DRAWINGS

The preferred embodiments will now be described with the following accompanying drawings, in which.

DETAILED DESCRIPTION

Figure 1:
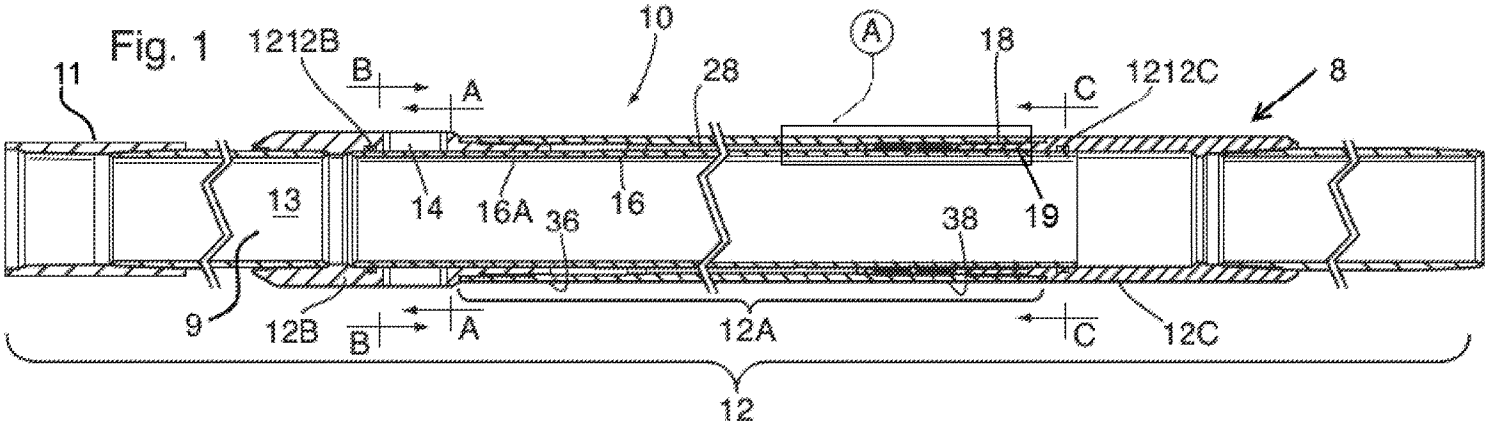
FIG. 1 is a side sectional view of an embodiment of a flow control apparatus of the present disclosure, incorporated within a wellbore string, with the valve closure member disposed in the closed position.

As used herein, the terms "up", "upward", "upper", or "uphole", mean, relativistically, in closer proximity to the surface and further away from the bottom of the wellbore, when measured along the longitudinal axis of the wellbore. The terms "down", "downward", "lower", or "downhole"

mean, relativistically, further away from the surface and in closer proximity to the bottom of the wellbore, when measured along the longitudinal axis of the wellbore.

Referring to FIGS. 5 to 8, there is provided a downhole tool system including a flow control apparatus 10 and a bottomhole assembly 200. The downhole tool system is configured for effecting selective stimulation of a subterranean formation 100, such as a hydrocarbon-containing reservoir.

The stimulation is effected by supplying treatment material to the subterranean formation.

In some embodiments, for example, the treatment material is a liquid including water. In some embodiments, for example, the liquid includes water and chemical additives. In other embodiments, for example, the treatment material is a slurry including water, proppant, and chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the treatment material is supplied to effect hydraulic fracturing of the reservoir.

In some embodiments, for example, the treatment material includes water, and is supplied to effect waterflooding of the reservoir.

The flow control apparatus 10 is configured to be integrated within a wellbore string 11 that is deployable within the wellbore 102. Suitable wellbores 102 include vertical, horizontal, deviated or multi-lateral wells. Integration may be effected, for example, by way of threading or welding.

The wellbore string 11 may include pipe, casing, or liner, and may also include various forms of tubular segments, such as the flow control apparatuses 100 described herein. The wellbore string 11 defines a wellbore string passage 2

Successive flow control apparatuses 10 may be spaced from each other within the wellbore string 11 such that each flow control apparatus 10 is positioned adjacent a producing interval to be stimulated by fluid treatment effected by treatment material that may be supplied through a port 14 (see below).

Referring to FIG. 1, in some embodiments, for example, the flow control apparatus 10 includes a housing 8. A passage 13 is defined within the housing 8. The passage 13 is configured for conducting treatment material, that is received from a supply source (such as a supply source disposed at the surface), to a flow control apparatus port 14 that is also defined within and extends through the housing 8. As well, in some embodiments, for example, the passage 13 is configured to receive a bottomhole assembly 200 (see below) to actuate a flow control member 16 of the flow control apparatus 10 (see below). In some embodiments, for example, the flow control apparatus 10 is a valve apparatus, and the flow control member 16 is a valve closure member.

In some embodiments, for example, the housing 8 includes an intermediate housing section 12A (such as a "barrel"), an upper crossover sub 12B, and a lower crossover sub 12C. The intermediate housing section 12A is disposed between the upper and lower crossover subs 12B, 12C. In some embodiments, for example, the intermediate housing section 12A is disposed between the upper and lower crossover subs 12B, 12C, and is joined to both of the upper and lower crossover subs with threaded connections. Axial and torsional forces may be translated from the upper crossover sub 12B to the lower crossover sub 12C via the intermediate housing section 12A.

The housing 8 is coupled (such as, for example, threaded) to other segments of the wellbore string 11, such that the wellbore string passage 2 includes the housing passage 13. In some embodiments, for example, the wellbore string 11 is lining the wellbore 102. The wellbore string 11 is provided for, amongst other things, supporting the subterranean formation within which the wellbore is disposed. As well, in some embodiments, for example, the wellbore string passage 2 of the wellbore string 11 functions for conducting treatment material from a supply source. The wellbore string 11 may include multiple segments, and the segments may be connected (such as by a threaded connection).

In some embodiments, for example, it is desirable to inject treatment material into a predetermined zone (or "interval") of the subterranean formation 100 via the wellbore 102. In this respect, the treatment material is supplied into the wellbore 102, and the flow of the supplied treatment material is controlled such that a sufficient fraction of the supplied treatment material (in some embodiments, all, or substantially all, of the supplied treatment material) is directed, via a flow control apparatus port 14 of the flow control apparatus 10, to the predetermined zone. In some embodiments, for example, the flow control apparatus port 14 extends through the housing 8. During treatment, the flow control apparatus port 14 effects fluid communication between the passage 13 and the subterranean formation 100. In this respect, during treatment, treatment material being conducted from the treatment material source via the passage 13 is supplied to the subterranean formation 100 via the flow control apparatus port 14.

As a corollary, the flow of the supplied treatment material is controlled such that injection of the injected treatment material to another zone of the subterranean formation is prevented, substantially prevented, or at least interfered with. The controlling of the flow of the supplied treatment material, within the wellbore 102, is effected, at least in part, by the flow control apparatus 10.

In some embodiments, for example, conduction of the supplied treatment to other than the predetermined zone may be effected, notwithstanding the flow control apparatus 10, through an annulus 112, that is disposed within the wellbore 102, between the wellbore string 11 and the subterranean formation 100. To prevent, or at least interfere, with conduction of the supplied treatment material to a zone of interval of the subterranean formation that is remote from the zone or interval of the subterranean formation to which it is intended that the treatment material is supplied, fluid communication, through the annulus, between the port 14 and the remote zone, is prevented, or substantially prevented, or at least interfered with, by a zonal isolation material 104. In some embodiments, for example, the zonal isolation material includes cement, and, in such cases, during installation of the assembly within the wellbore, the casing string is cemented to the subterranean formation, and the resulting system is referred to as a cemented completion.

To at least mitigate ingress of cement during cementing, and also at least mitigate curing of cement in space that is in proximity to the flow control apparatus port 14, or of any cement that has become disposed within the port 14, prior to cementing, the port 14 may be filled with a viscous liquid material having a viscosity of at least 100 $mm^2/s$ at 40 degrees Celsius. Suitable viscous liquid materials include encapsulated cement retardant or grease. An exemplary grease is SKF LGHP 2TM grease. For illustrative purposes below, a cement retardant is described. However, it should be understood, other types of liquid viscous materials, as defined above, could be used in substitution for cement retardants.

In some embodiments, for example, the zonal isolation material includes a packer, and, in such cases, such completion is referred to as an open-hole completion.

In some embodiments, for example, the flow control apparatus 10 includes the flow control member 16, and the flow control member 16 is displaceable, relative to the flow control apparatus port 14, for effecting opening and closing of the flow control apparatus port 14. In this respect, the flow control member 16 is displaceable such that the flow control member 16 is positionable in open (see FIG. 4) and closed (see FIG. 1) positions. The open position of the flow control member 16 corresponds to an open condition of the flow control apparatus port 14. The closed position of the flow control member 16 corresponds to a closed condition of the flow control apparatus port 14.

In some embodiments, for example, in the closed position, the flow control apparatus port 14 is covered by the flow control member 16, and the displacement of the flow control member 16 to the open position effects at least a partial uncovering of the flow control apparatus port 14 such that the flow control apparatus port 14 becomes disposed in the open condition. In some embodiments, for example, in the closed position, the flow control member 16 is disposed, relative to the flow control apparatus port 14, such that a sealed interface is disposed between the passage 13 and the subterranean formation 100, and the disposition of the sealed interface is such that treatment material being supplied through the passage 13 is prevented, or substantially prevented, from being injected, via the flow control apparatus port 14, into the subterranean formation 100, and displacement of the flow control member 16 to the open position effects fluid communication, via the flow control apparatus port 14, between the passage 13 and the subterranean formation 100, such that treatment material being supplied through the passage 13 is injected into the subterranean formation 100 through the flow control apparatus port 14. In some embodiments, for example, the sealed interface is established by sealing engagement between the flow control member 16 and the housing 8. In some embodiments, for example, "substantially preventing fluid flow through the flow control apparatus port 14" means, with respect to the flow control apparatus port 14, that less than 10 volume %, if any, of fluid treatment (based on the total volume of the fluid treatment) being conducted through the passage 13 is being conducted through the flow control apparatus port 14.

In some embodiments, for example, the flow control member 16 includes a sleeve. The sleeve is slideably disposed within the passage 13.

In some embodiments, for example, the flow control member 16 is displaced from the closed position (see FIG. 1) to the open position (see FIG. 4) and thereby effect opening of the flow control apparatus port 14. Such displacement is effected while the flow control apparatus 10 is deployed downhole within a wellbore 102 (such as, for example, as part of a wellbore string 11), and such displacement, and consequential opening of the flow control apparatus port 14, enables treatment material, that is being supplied from the surface and through the wellbore 102 via the wellbore string 11, to be injected into the subterranean formation 100 via the flow control apparatus port 14. In some embodiments, for example, by enabling displacement of the flow control member 16 between the open and closed positions, pressure management during hydraulic fracturing is made possible.

In some embodiments, for example, the flow control member 16 is displaced from the open position to the closed position and thereby effect closing of the port 16. Displacing the flow control member 16 from the open position to the closed position may be effected after completion of the supplying of treatment material to the subterranean formation 100 through the flow control apparatus port 14. In some embodiments, for example, this enables the delaying of production through the flow control apparatus port 14, facilitates controlling of wellbore pressure, and also mitigates ingress of sand from the formation 100 into the casing, while other zones of the subterranean formation 100 are now supplied with the treatment material through other ports 14. In this respect, after sufficient time has elapsed after the supplying of the treatment material to a zone of the subterranean formation 100, such that meaningful fluid communication has become established between the hydrocarbons within the zone of the subterranean formation 100 and the flow control apparatus port 14, by virtue of the interaction between the subterranean formation 100 and the treatment material that has been previously supplied into the subterranean formation 100 through the flow control apparatus port 14, and, optionally, after other zones of the subterranean formation 100 have similarly become disposed in fluid communication with other ports 14, the flow control member(s) may be displaced to the open position so as to enable production through the wellbore. Displacing the flow control member 16 from the open position to the closed position may also be effected while fluids are being produced from the formation 100 through the flow control apparatus port 14, and in response to sensing of a sufficiently high rate of water production from the formation 100 through the flow control apparatus port 14. In such case, displacing the flow control member 16 to the closed position blocks, or at least interferes with, further production through the associated flow control apparatus port 14.

The flow control member 16 is configured for displacement, relative to the flow control apparatus port 14, in response to application of a sufficient force. In some embodiments, for example, the application of a sufficient force is effected by a sufficient fluid pressure differential that is established across the flow control member 16. In some embodiment embodiments, for example, for example, the sufficient force is established by a force, applied to a bottomhole assembly 200, and then translated, via the bottomhole assembly 200, to the flow control member 16 (see below). In some embodiments, for example, the sufficient force, applied to effect opening of the flow control apparatus port 14 is a flow control member opening force, and the sufficient force, applied to effect closing of the port is a flow control member closing force.

In some embodiments, for example, the housing 8 includes an inlet 9. While the apparatus 100 is integrated within the wellbore string 11, and while the wellbore string 11 is disposed downhole within a wellbore 102 such that the inlet 9 is disposed in fluid communication with the surface via the wellbore string 11, and while the flow control apparatus port 14 is disposed in the open condition, fluid communication is effected between the inlet 9 and the subterranean formation 100 via the passage 13, and via the flow control apparatus port 14, such that the subterranean formation 100 is also disposed in fluid communication, via the flow control apparatus port 14, with the surface (such as, for example, a source of treatment fluid) via the wellbore string 11. Conversely, while the flow control apparatus port 14 is disposed in the closed condition, at least increased interference, relative to that while the port 14 is disposed in the open condition, to fluid communication (and, in some embodiments, sealing, or substantial sealing, of fluid communication), between the inlet 9 and the subterranean formation 100, is effected such that the sealing, or substantial sealing, of fluid communication, between the subterranean formation 100 and the surface, via the flow control apparatus port 14, is also effected.

Figure 4:
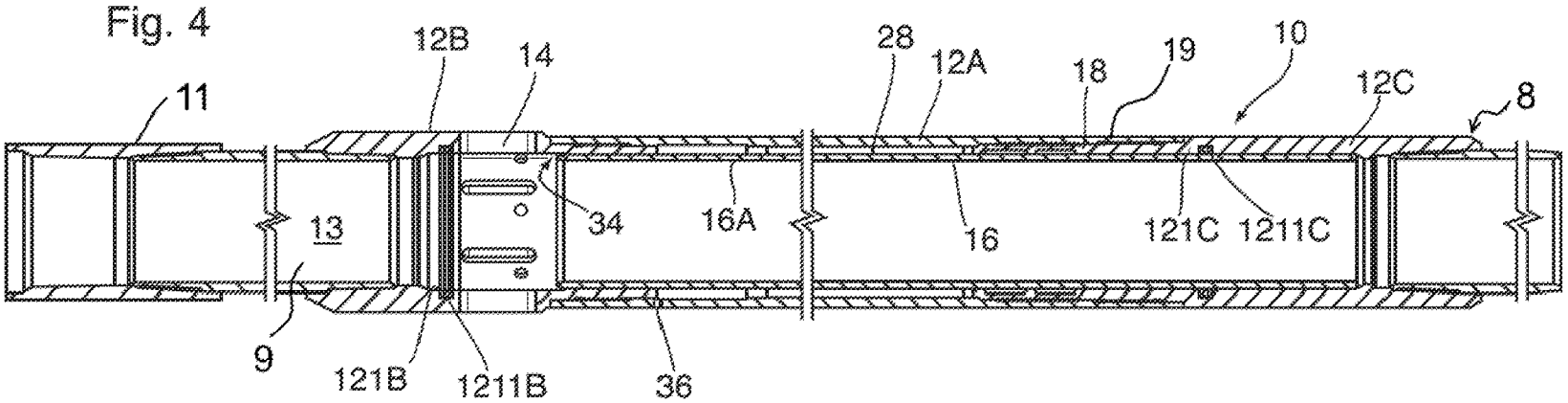
FIG. 4 is a side sectional view of the flow control apparatus, incorporated within a wellbore string, as illustrated in FIG. 1, with the flow control member disposed in the open position.

Referring to FIGS. 1 and 4, in some embodiments, for example, the housing 8 includes one or more sealing surfaces configured for sealing engagement with a flow control member 16, wherein the sealing engagement defines the sealed interface described above. In this respect, the internal surface 121B, 121C of each one of the upper and lower crossover subs, independently, includes a respective one of the sealing surfaces 1211B, 1211C, and the sealing surfaces 1211B, 1211C are configured for sealing engagement with the flow control member 16. In some embodiments, for example, for each one of the upper and lower crossover subs 12B, 12C, independently, the sealing surface 1211B, 1211C is defined by a respective sealing member 1212B, 1212C. In some embodiments, for example, when the flow control member 16 is in the closed position, each one of the sealing members 1212B, 1212C, is, independently, disposed in sealing engagement with both of the valve housing 8 (for example, the sealing member 1212B is sealingly engaged to the upper crossover sub 12B and housed within a recess formed within the sub 12B, and the sealing member 1212C is sealingly engaged to the lower crossover sub 12C and housed within a recess formed within the sub 12C) and the flow control member 16. In some embodiments, for example, each one of the sealing members 1212B, 1212C, independently, includes an o-ring. In some embodiments, for example, the o-ring is housed within a recess formed within the respective crossover sub. In some embodiments, for example, the sealing member 1212B, 1212C includes a molded sealing member (i.e. a sealing member that is fitted within, and/or bonded to, a groove formed within the sub that receives the sealing member).

In some embodiments, for example, the flow control apparatus port 14 extends through the housing 8, and is disposed between the sealing surfaces 1211B, 1211C.

In some embodiments, for example, the flow control member 16 co-operates with the sealing members 1212B, 1212C to effect opening and closing of the flow control apparatus port 14. When the flow control apparatus port 14 is disposed in the closed condition, the flow control member 16 is sealingly engaged to both of the sealing members 1212B, 1212C, and thereby preventing, or substantially preventing, treatment material, being supplied through the passage 13, from being injected into the subterranean formation 100 via the flow control apparatus port 14. When the flow control apparatus port 14 is disposed in the open condition, the flow control member 16 is spaced apart or retracted from at least one of the sealing members (such as the sealing member 1212B), thereby providing a passage for treatment material, being supplied through the passage 13, to be injected into the subterranean formation 100 via the flow control apparatus port 14.

Figure 4A:
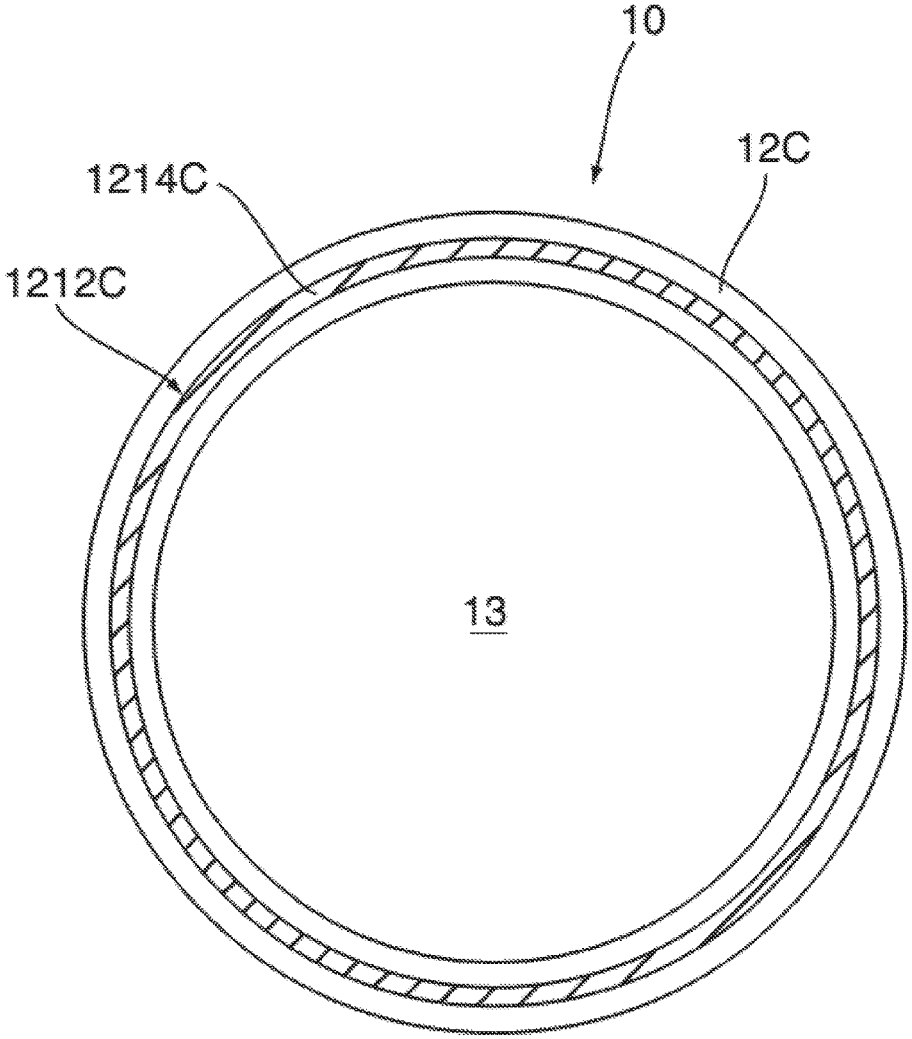
FIG. 4A is a sectional view taken along lines B-B in FIG. 1.
Figure 4B:
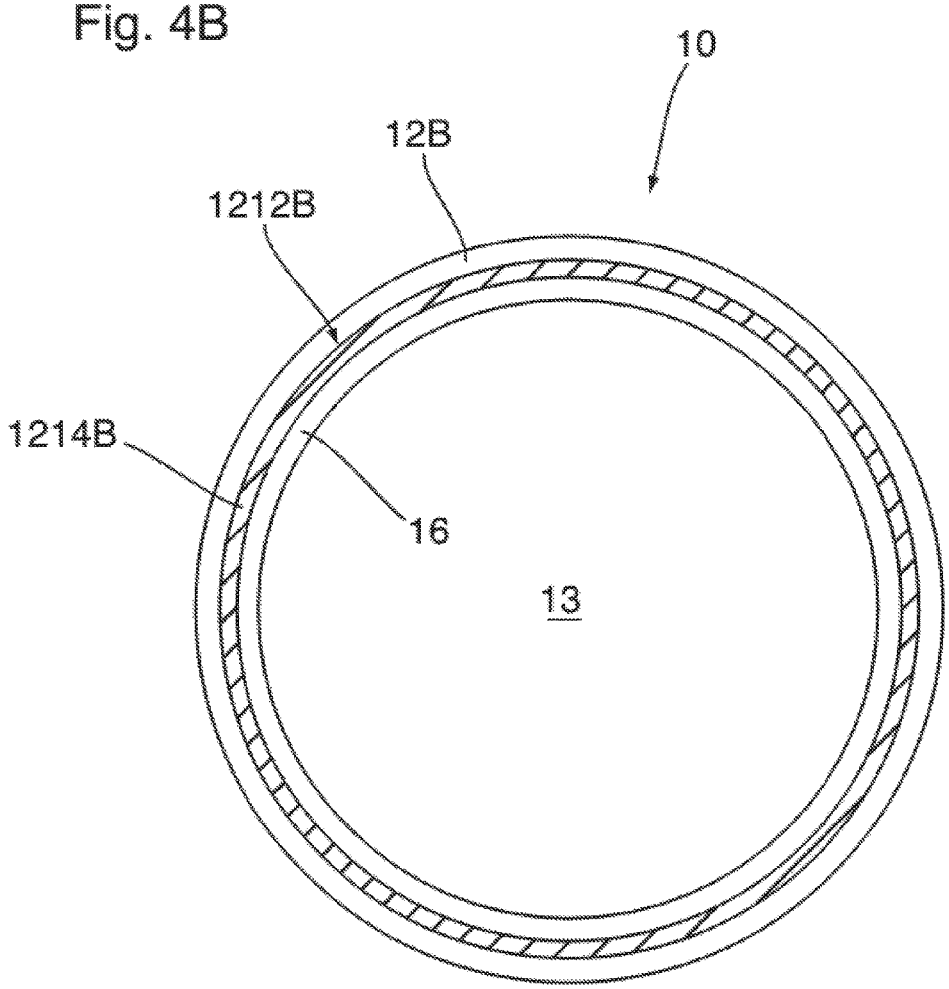
FIG. 4B is a sectional view taken along lines C-C in FIG. 1.

Referring to FIGS. 4A and 4B, in some embodiments, for example, each one of the sealing members 1212B, 1212C, independently, defines a respective fluid pressure responsive surface 1214B, 1214C, with effect that while the flow control member 16 is disposed in the closed position, and in sealing engagement with the sealing members 1212B, 1212C, each one of the fluid pressure responsive surfaces 1214B, 1214C, independently, is configured to receive application of fluid pressure from fluid disposed within the passage 13. In some embodiments, for example, each one of the surfaces 1214B, 1214C, independently, extends between the valve housing 8 (for example, the surface 1214B extends from the upper crossover sub 12B, such as a groove formed or provided in the upper crossover sub 12B, and the surface 1214C extends from the lower crossover sub 12C, such as a groove formed or provided in the lower crossover sub 12C) and the flow control member 16. In one aspect, the total surface area of one of the surfaces 1214B, 1214C is at least 90% of the total surface area of the other one of the surfaces 1214B, 1214C. In some embodiments, for example, the total surface area of one of the surfaces 1214B, 1414C is at least 95% of the total surface area of the other one of the surfaces 1214B, 1214C. In some embodiments, for example, the total surface area of the surface 1214B is the same, or substantially the same, as the total surface area of the surface 1214C. By co-operatively configuring the surfaces 1214B, 1214C in this manner, inadvertent opening of the flow control member 16, by unbalanced fluid pressure forces, is mitigated.

Referring to FIGS. 1, 2, 2A, 2B, 2C, and 4, a resilient retainer member 18 extends from the housing 12, and is configured to releasably engage the flow control member 16 for resisting a displacement of the flow control member 16. In this respect, in some embodiments, for example, the resilient retainer member 18 includes at least one finger 18A, and each one of the at least one finger includes a tab 18B that engages the flow control member 16. In some embodiments, for example, the engagement of the tab 18B to the flow control member 16 is effected by disposition of the tab 18B within a recess of the flow control member 16.

In some embodiments, for example, the flow control apparatus 10 includes a collet 19 that extends from the housing 12, and the collet 19 includes the resilient retainer member 18.

In some embodiments, for example, the flow control member 16 and the resilient retainer member 18 are co-operatively configured such that engagement of the flow control member 16 and the resilient retainer member 18 is effected while the flow control member 16 is disposed in the open position and also when the flow control member 16 is disposed in the closed position. In this respect, while the flow control member 16 is disposed in the closed position, the resilient retainer member 18 is engaging the flow control member 16 such that resistance is being effected to displacement of the flow control member 16 from the closed position to the open position. In some embodiments, for example, the engagement is such that the resilient retainer member 18 is retaining the flow control member 16 in the closed position. Also in this respect, while the flow control member 16 is disposed in the open position, the resilient retainer member 18 is engaging the flow control member 16 such that resistance is being effected to displacement of the flow control member 16 from the open position to the closed position. In some embodiments, for example, the engagement is such that the resilient retainer member 18 is retaining the flow control member 16 in the open position.

Figure 2:
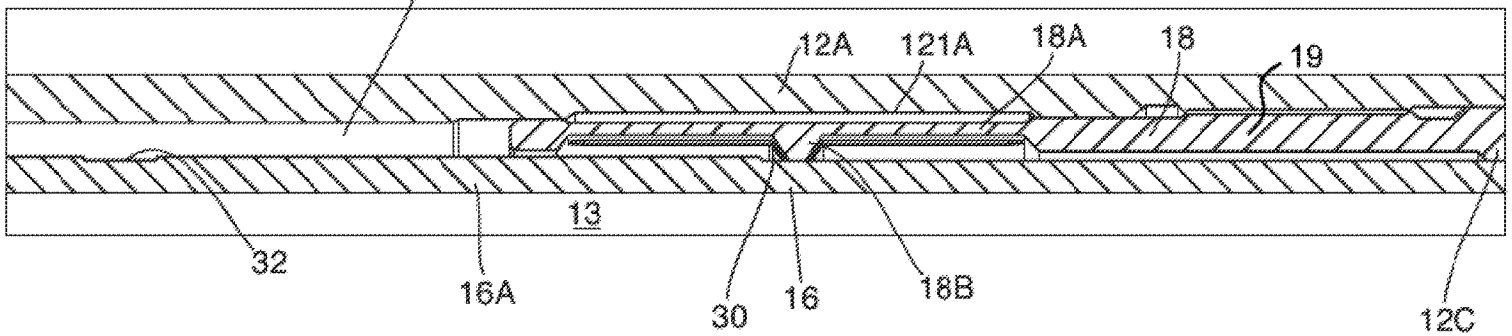
FIG. 2 is an enlarged view of Detail "A" of FIG. 1.
Figure 2A:
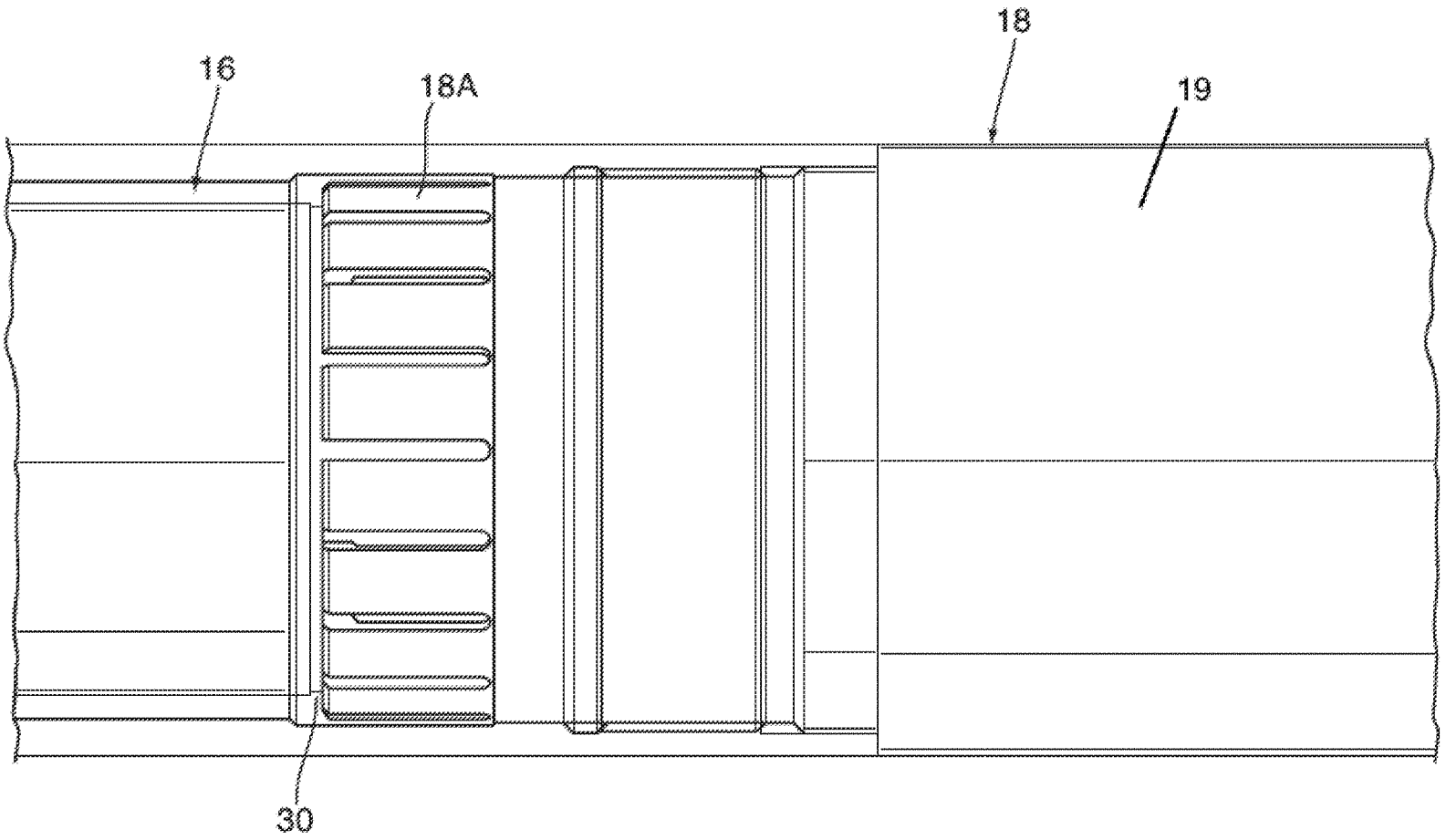
FIG. 2A is a detailed elevation view of a portion of the flow control apparatus of FIG. 1, illustrating the collet disposed in engagement with the closed position-defining recess of the valve closure member.
Figure 2B:
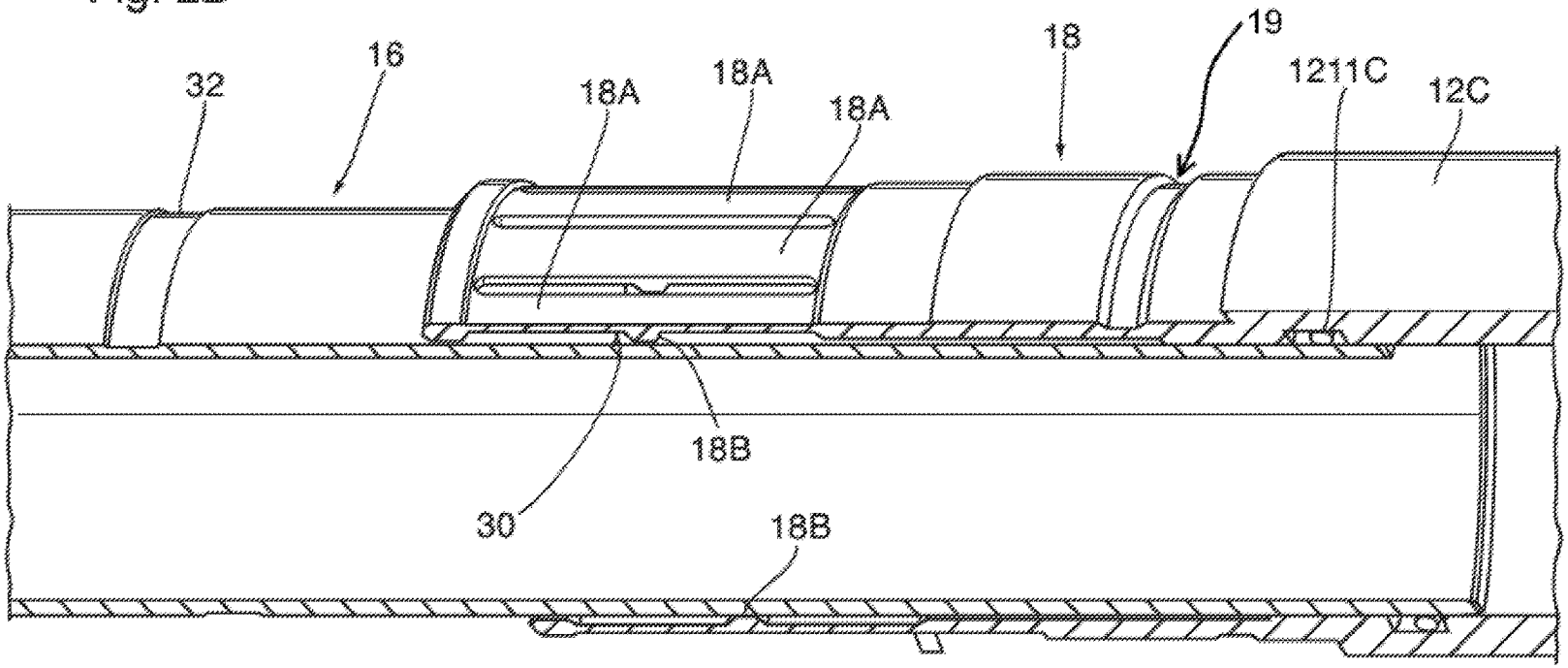
FIG. 2B is a detailed fragmentary perspective view of a portion of the flow control apparatus of FIG. 1, illustrating the collet disposed in engagement with the closed position-defining recess of the valve closure member.
Figure 2C:
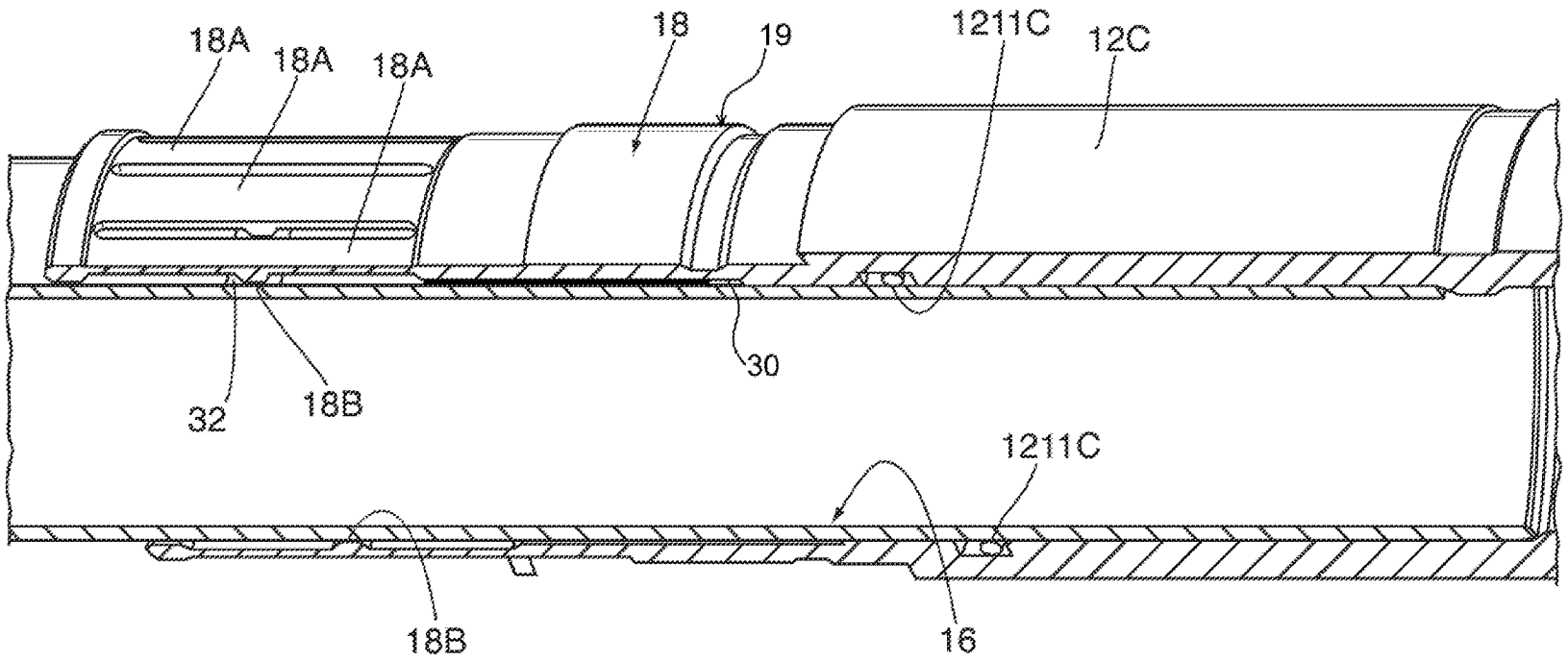
FIG. 2C is a detailed fragmentary perspective view of a portion of the flow control apparatus of FIG. 1, illustrating the collet disposed in engagement with the open position-defining recess of the valve closure member.

Referring to FIGS. 2 and 2A, in some embodiments, for example, the flow control member 16 includes a closed position-defining recess 30 and an open position-defining recess 32. The at least one finger 18A and the recesses 30, 32 are co-operatively configured such that while the flow control member 16 is disposed in the closed position, the finger tab 18B is disposed within the closed position-defining recess 30 (see FIG. 2B), and, while the flow control member 16 is disposed in the open position, the finger tab 18B is disposed within the open position-defining recess 32 (see FIG. 2C).

In some embodiments, for example, the resilient retainer member 18 is resilient such that the resilient retainer member 18 is displaceable from the engagement with the flow control member 16 in response to application of the opening force to the flow control member 16. In some embodiments, for example, such displacement includes deflection of the resilient retainer member 18. In some embodiments, for example, the deflection includes a deflection of a finger tab 18B that is disposed within a recess of the flow control member 16, and the deflection of the finger tab 18B is such that the finger tab 18B becomes disposed outside of the recess of the flow control member 16. When the flow control member 16 is disposed in the open position, such displacement removes the resistance being effected to displacement of the flow control member 16 from the open position to the closed position (and thereby permit the flow control member 16 to be displaced from the open position to the closed position, in response to application of an opening force). When the flow control member 16 is disposed in the closed position, such displacement removes the resistance being effected to displacement of the flow control member 16 from the closed position to the open position (and thereby permit the flow control member 16 to be displaced from the closed position to the open position, in response to application of a closing force).

In some embodiments, for example. in order to effect the displacement of the flow control member 16 from the closed position to the open position, the opening force is sufficient to effect displacement of the finger tab 18B from (or out of) the closed position-defining recess 30. In this respect, the tab 18B is sufficiently resilient such that application of the opening force effects the displacement of the tab 18B from the recess 30, such as by the deflection of the tab 18B. Once the finger tab 18B has become displaced out of the closed position-defining recess 30, continued application of force to the flow control member 16 (such as, in the illustrated embodiment, in a downwardly direction) effects displacement of the flow control member 16 from the closed position to the open position. In order to effect the displacement of the flow control member 16 from the open position to the closed position, the closing force is sufficient to effect displacement of the finger tab 18B from (or out of) the open position-defining recess 32, such as by deflection of the tab 18B. In this respect, the tab 18B is sufficiently resilient such that application of the closing force effects the displacement of the tab 18B from the recess 32. Once the finger tab 18B has become displaced out of the open position-defining recess 32, continued application of force to the flow control member 16 (such as, in the illustrated embodiment, in an upwardly direction) effects displacement of the flow control member 16 from the open position to the closed position.

Each one of the opening force and the closing force may be, independently, applied to the flow control member 16 mechanically, hydraulically, or a combination thereof. In some embodiments, for example, the applied force is a mechanical force, and such force is applied by a shifting tool. In some embodiments, for example, the applied force is hydraulic, and is applied by a pressurized fluid.

Figure 3:
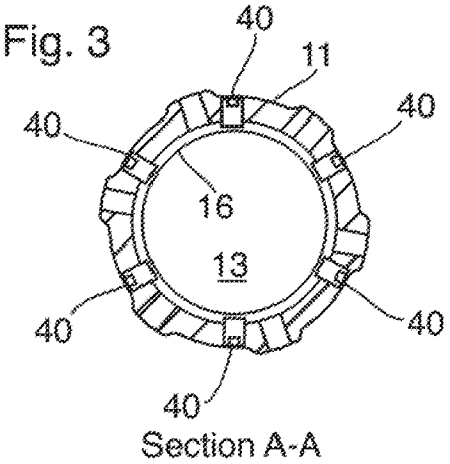
FIG. 3 is a sectional view taken along lines A-A in FIG. 1.

Referring to FIG. 3, in some embodiments, for example, while the apparatus 10 is being deployed downhole, the flow control member 16 is maintained disposed in the closed position by one or more shear pins 40. The one or more shear pins 40 are provided to secure the flow control member 16 to the wellbore string 11 (including while the wellbore string is being installed downhole) so that the passage 13 is maintained fluidically isolated from the formation 100 until it is desired to treat the formation 100 with treatment material. To effect the initial displacement of the flow control member 16 from the closed position to the open position, sufficient force must be applied to the one or more shear pins 40 such that the one or more shear pins become sheared, resulting in the flow control member 16 becoming moveable relative to the flow control apparatus port 14. In some operational implementations, the force that effects the shearing is applied by a workstring (see below).

Referring to FIGS. 1, 2 and 4, the intermediate housing section 12A and the flow control member 16 are co-operatively positioned relative to one another to define a retainer housing space 28 between the intermediate housing section 12A and the flow control member 16. In some of these embodiments, for example, each one of the sealing surfaces 1211B, 1211C (of the upper and lower crossover subs 12B, 12C), independently, is disposed closer to the axis of the passage 13 than an internal surface 121A of the intermediate housing section 121A. In some embodiments, for example, the internal surface 121A of the intermediate housing section 12A is disposed further laterally (e.g. radially) outwardly from the axis of the passage 13, relative to the sealing surfaces 1211B, 1211C, such that the retainer housing space 28 is disposed between the intermediate housing section 12A and the flow control member 16 while the flow control member 16 is disposed in sealing engagement to the sealing surfaces 1211B, 1211C, and thus disposed in the closed position.

The retainer housing space 28 co-operates with the flow control member 16 such that, at least while the flow control member 16 is disposed in the closed position, fluid communication between the retainer housing space 28 and the passage 13 is prevented or substantially prevented. By providing this configuration, the ingress of solid material, such as solid debris or proppant, from the passage 13 and into the retainer housing space 28, which may otherwise interfere with co-operation of the resilient retainer member 18 and the flow control member 16, and may also interfere with displacement of the flow control member 16, is at least mitigated.

In some embodiments, for example, such as in the embodiment illustrated in FIG. 4, while the flow control member 16 is disposed in the open position, at least some fluid communication may become established, within the wellbore string 11, between the passage 13 and the retainer housing space 28, albeit through a fluid passage 34, within the valve housing 8, defined by a space between the upper cross-over sub 12B and the flow control member 16, having a relatively small cross-sectional flow area, and defining a relatively tortuous flowpath. In this respect, in some embodiments, for example, the upper cross-over sub 12B and the flow control member 16 are closely-spaced relative to one another such that any fluid passage 34 that is defined by a space between the upper cross-over sub 12B and the flow control member 16, and effecting fluid communication between the passage 13 and the retainer housing space 28, has a maximum cross-sectional area of less than 0.30 square inches (such as 0.01 square inches). In some embodiments, for example, the upper cross-over sub 12B and the flow control member 16 are closely-spaced relative to one another such that any fluid passage 34 that is defined by a space between the upper cross-over sub 12B and the flow control member 16, and effecting fluid communication between the casing passage 13 and the retainer housing space 28, has a maximum cross-sectional area of less than 0.30 square inches (such as 0.01 square inches). In some embodiments, the passage 34 has a maximum cross-sectional area of less than 0.20 square inches. By providing this configuration, the ingress of solid material, such as solid debris or proppant, from the passage 13 and into the retainer housing space 28, which may otherwise interfere with co-operation of the resilient retainer member 18 and the flow control member 16, and may also interfere with movement of the flow control member 16, is at least mitigated.

In some embodiments, for example, an additional sealing member may be disposed (such as, for example, downhole of the flow control apparatus port 14) within the space between the upper cross-over sub 12B and the flow control member 16 (for example, such as being trapped within a groove formed or provided in the upper crossover sub 12B), for sealing fluid communication between passage 13 and the retainer housing space 28, and, when the flow control member 16 is disposed in the open position, for sealing fluid communication between the flow control apparatus port 14 and the retainer housing space 28.

Referring to FIGS. 1 and 4, a vent hole 36 extends through the intermediate housing section 12A, for venting the retainer housing space 28 externally of the intermediate housing section 12A. By providing for fluid communication between the retainer housing space 28 and the formation 100 through the vent hole 36, the creation of a pressure differential between the formation 100 and the retainer housing space 28, and across the intermediate housing section 12A, including while the flow control member 16 is disposed in the closed position, is at least mitigated, and thereby at least mitigating application of stresses (such as hoop stress) to the intermediate housing section 12A. By mitigating stresses being applied to the intermediate housing section 12A, the intermediate housing section does not need to be designed to such robust standards so as to withstand applied stresses, such as those which may be effected if there existed a high pressure differential between the formation 100 and the space between the intermediate housing section and the flow control member 16. In some embodiments, for example, the intermediate housing section 12A may include 5-½ American Petroleum Institute ("API") casing, P110, 17 pounds per foot. In some embodiments, for example, the section 12A includes mechanical tubing. In some embodiments, the vent hole 36 has a minimum cross-sectional area of greater than 0.1 square inches.

Prior to cementing, the retainer housing space 28 may be filled with encapsulated cement retardant through the grease injection hole 38 (and, optionally, the vent hole 36), so as to at least mitigate ingress of cement during cementing, and also to at least mitigate curing of cement in space that is in proximity to the vent hole 36, or of any cement that has become disposed within the vent hole or the retainer housing space 28. In those embodiments where, while the flow control member 16 is disposed in the open position, fluid communication may become effected, within the wellbore string 11, between the retainer housing space 28 and the passage 13 through a relatively small fluid passage 34 defined between the flow control member 16 and the upper cross-over sub 12B, the encapsulated cement retardant disposed within the retainer housing space 28, in combination with the relatively small flow area provided by the fluid passage 34 established between the upper cross-over sub 12B and the flow control member 16 (while the flow control member 16 is disposed in the open position), at least mitigates the ingress of solids (including debris or proppant) from within the passage 13, and/or from the fluid treatment flow control apparatus port 14, to the retainer housing space 28.

In those embodiments where the wellbore string 11 is cemented to the formation 100, and where each one of the cross-over subs 12B, 12C, independently, includes a sealing member 1211B, 1211C, during cementing, such sealing members may function to prevent ingress of cement into the retainer housing space 28, while the flow control member 16 is disposed in the closed position.

As mentioned above, in some embodiments, both of the opening force and the closing force are imparted by a shifting tool, and the shifting tool is integrated within a downhole tool 200, such as a bottomhole assembly 200, that includes other functionalities.

Referring to FIGS. 5 to 8, the bottomhole assembly 200 may be deployed within the wellbore 102, through the wellbore string passage 2 of the wellbore string 11, on a workstring 300. Suitable workstrings include tubing string, wireline, cable, or other suitable suspension or carriage systems. Suitable tubing strings include jointed pipe, concentric tubing, or coiled tubing. The workstring includes a fluid passage, extending from the surface, and disposed in, or disposable to assume, fluid communication with the fluid conductor of the tool. The deployed tool includes the bottomhole assembly 200 and the workstring 300.

The workstring 300 is coupled to the bottomhole assembly 200 such that forces applied to the workstring 200 are translated to the bottomhole assembly 200 to actuate movement of the flow control member 16.

While the bottomhole assembly 200 is deployed through the wellbore string passage 2 (and, therefore, through the wellbore 102), an intermediate (or annular) region 112 is defined within the wellbore string passage 2 between the bottomhole assembly 200 and the wellbore string 11.

In some embodiments, for example, the bottomhole assembly 200 includes a fluid conductor 202, a annular sealing member 204, an equalization valve 206, a sealing mandrel 208, and the shifting tool.

The fluid conductor 202 includes a fluid passage 2021. The fluid passage 2021 may be provided for effecting flow of fluid material for enabling, for example, perforation of the wellbore 102, or flushing of the wellbore 102 (see below), or for effecting flow of treatment material. The bottomhole assembly 200 is configured such that, for some implementations, while the assembly 200 is disposed within the wellbore 102, the fluid passage 2021 is disposed in fluid communication with the wellhead via the workstring 300.

The fluid conductor 202 includes fluid conductor ports 207. While the bottomhole assembly 200 is deployed within the wellbore 102, each one of the fluid conductor ports 207 extends between the annular region 112 and the fluid passage 2021. In this respect, in some operational implementations (see below), fluid communication is effected between the annular region 112 and the fluid passage 2021 through the fluid conductor ports 207.

Figure 6:
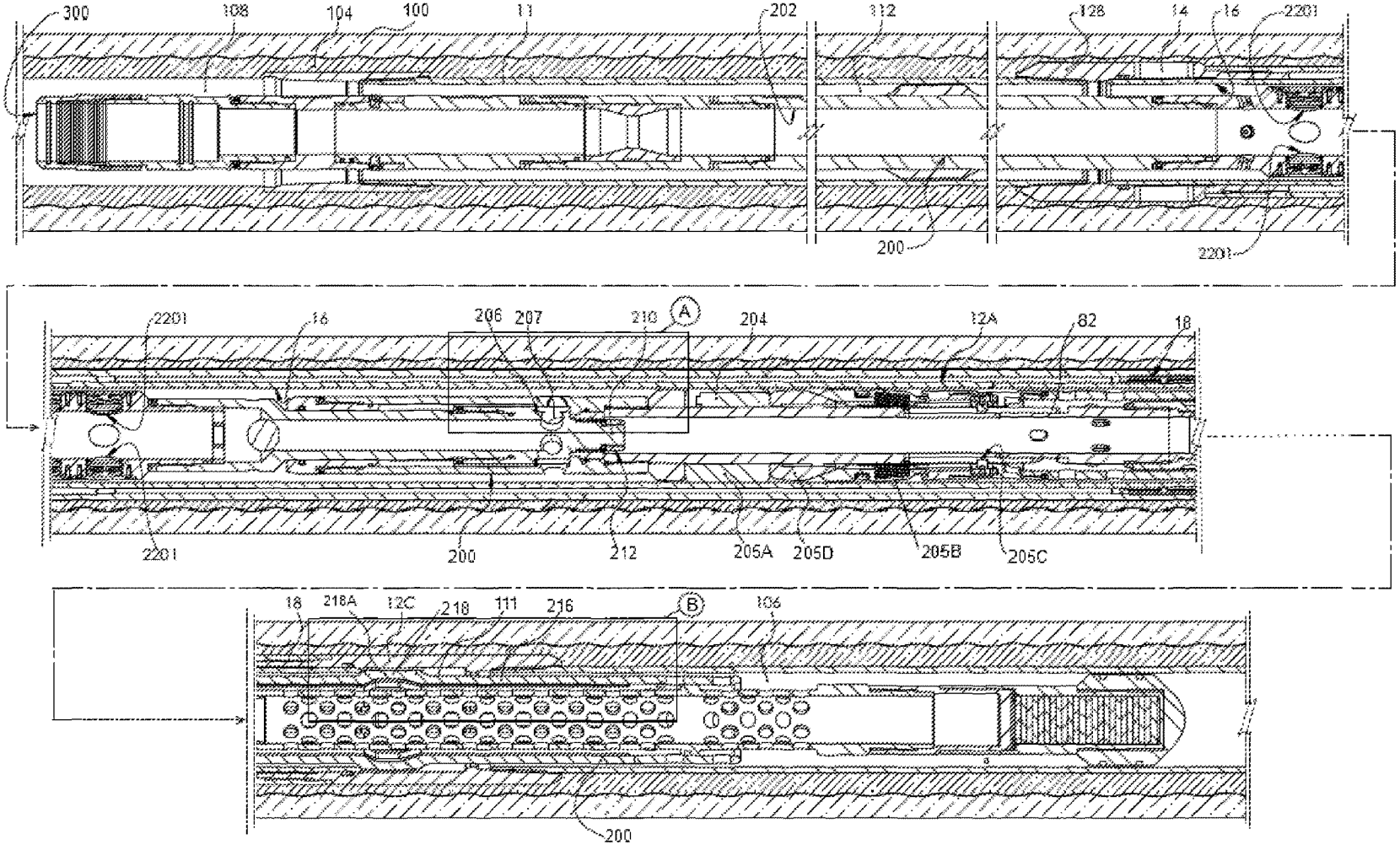
FIG. 6 is a side sectional view of the system shown in FIG. 5, illustrating the bottomhole assembly with the equalization valve having been moved further downhole relative to the first position in FIG. 5, and thereby effecting setting of the packer and its engagement to the flow control member.
Figure 6A:
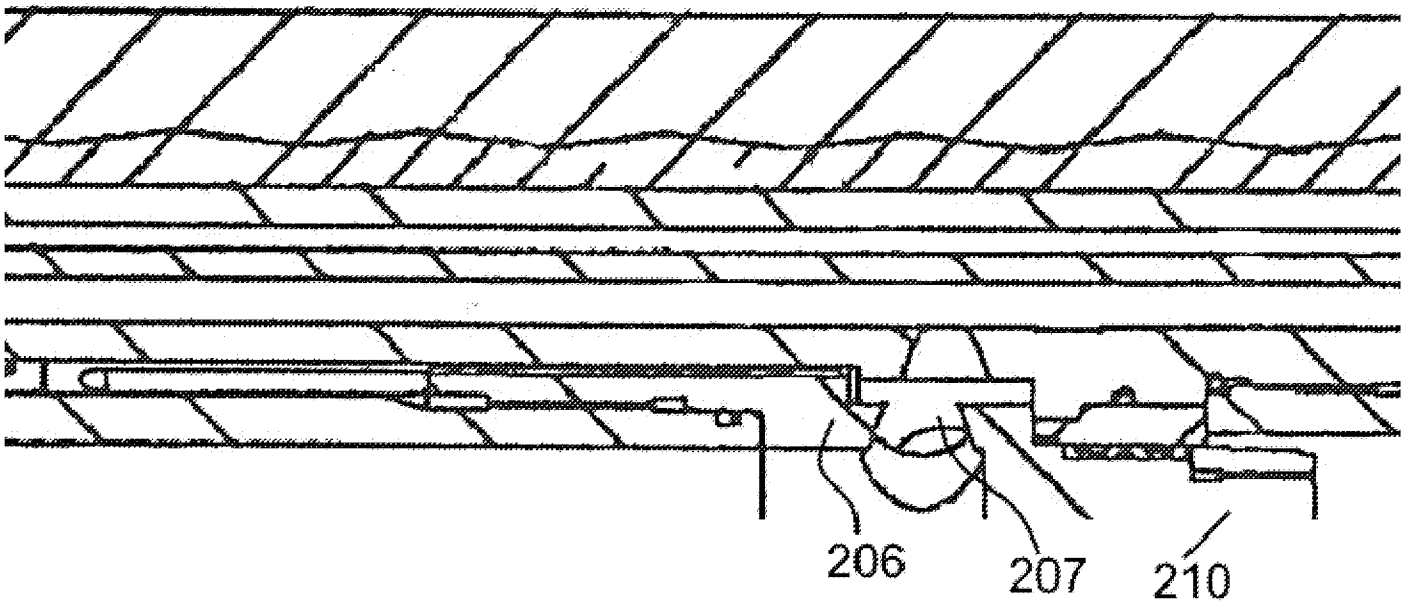
FIGS. 6A-6B are enlarged view of details "A" and "B" of FIG. 6, respectively.
Figure 6B:
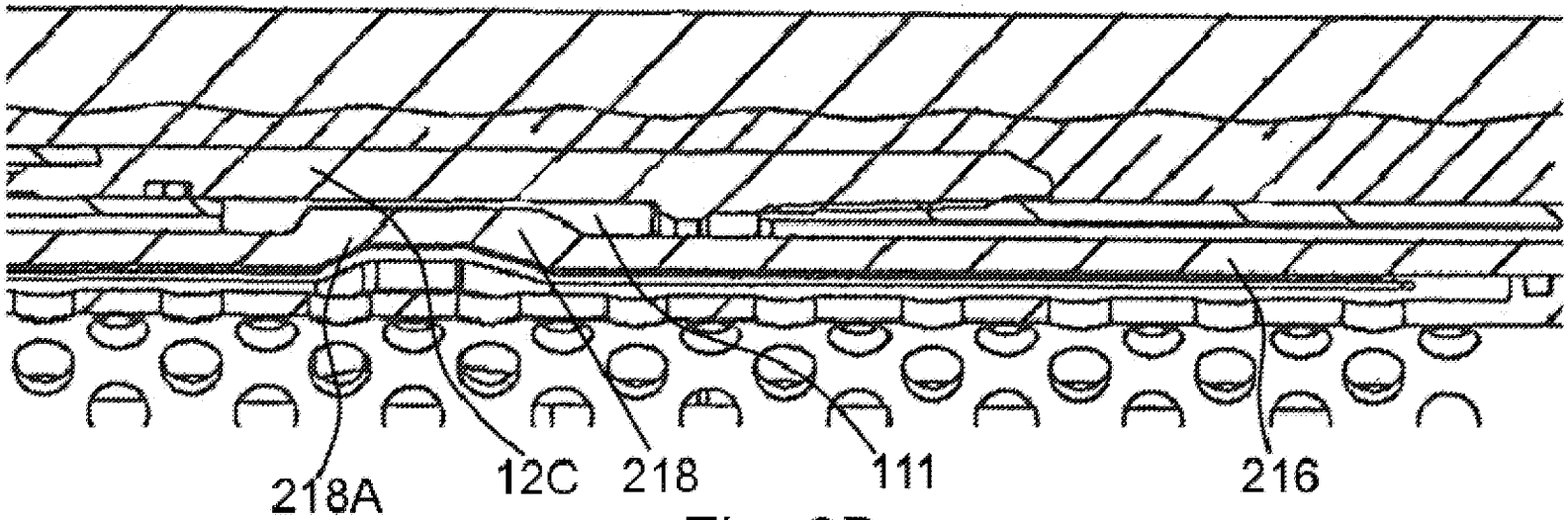
Figure 7:
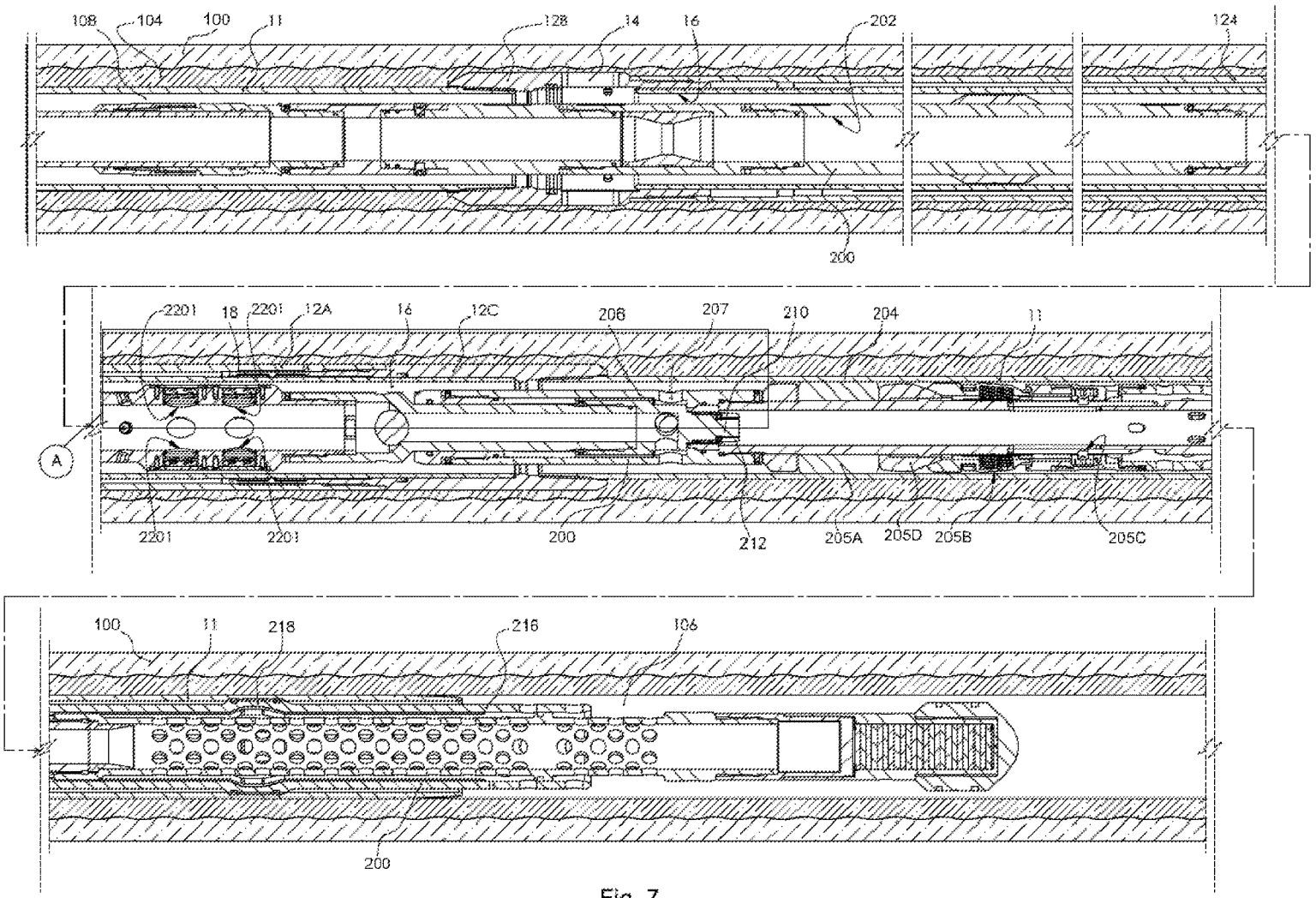
FIG. 7 is a side sectional view of the system shown in FIG. 5, illustrating the bottomhole assembly having effected displacement of the flow control member to the open position in response to displacement of the packer in a downhole direction.
Figure 7A:
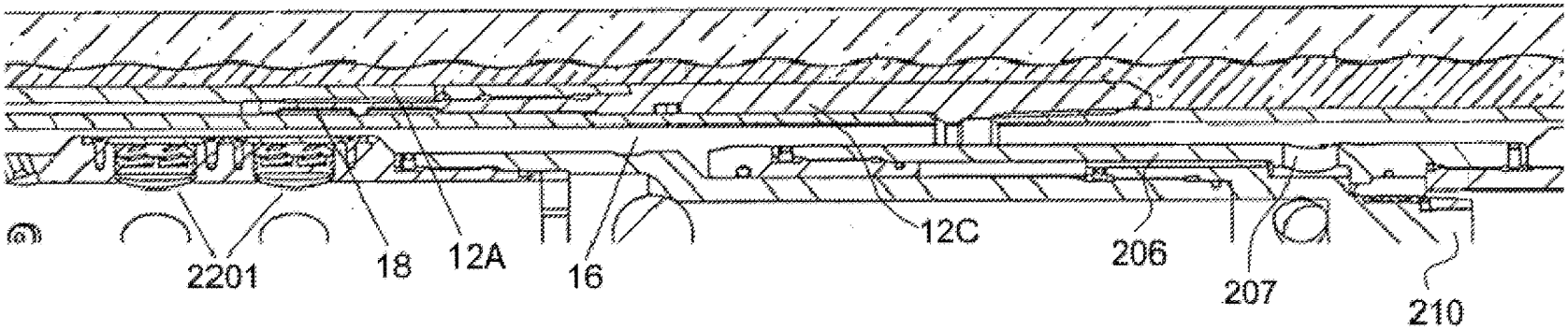
FIG. 7A is an enlarged view of detail "A" of FIG. 7.

The annular sealing member 204 is provided and configured for becoming disposed in sealing engagement with the wellbore string 11, such that a sealing interface is defined between the bottomhole assembly 200 and the wellbore string 11. The annular sealing member 204 is positioned over the sealing mandrel 208. The annular sealing member 204 is configured to be actuated into sealing engagement with the wellbore string 11 (and, specifically, the flow control member 16), in proximity to a flow control apparatus port 14 that is local to a selected treatment material interval, while the tool assembly 200 is deployed within the wellbore 102 and has been located within a predetermined position at which fluid treatment is desired to be a delivered to the formation 100. In this respect, the annular sealing member 204 is disposable between at least an unactuated condition (see FIGS. 5 and 8) and a sealing engagement condition (FIGS. 6 and 7). In the unactuated condition, the annular sealing member 204 is spaced apart (or in a retracted state) relative to the flow control member 16. In the sealing engagement condition, the annular sealing member 204 is disposed in the above-described sealing engagement with the flow control member 16, while the tool assembly 200 is deployed within the wellbore 102 and has been located within a predetermined position at which fluid treatment is desired to be a delivered to the formation 100. The sealing engagement is with effect that fluid communication, through the wellbore string passage 2 (and, therefore, the wellbore 102), via the annular region 112, and across the sealing member 204, between the treatment material interval and a downhole wellbore portion 106 disposed downhole of the sealing member 204, is sealed or substantially sealed.

In some embodiments, for example, a packer 205 is provided, and the packer 205 includes the resettable sealing member 205A, and the resettable sealing member includes the annular sealing member 204. In this respect, the packer 205 includes the sealing member 204. The packer 205 is positioned over the sealing mandrel 208 and is disposable between unset and set conditions. In the unset condition, while the assembly 200 is disposed within the wellbore 102, in some implementations (such as while the assembly 200 is located within a predetermined position at which fluid treatment is desired to be delivered to the formation 100) the sealing member 205A is spaced apart (in the retracted state) relative to the wellbore string 11, including being spaced apart from the flow control member 16, and thus, in effect, renders the sealing member 205A in the unactuated condition. In the set condition, while the tool assembly 200 is deployed within the wellbore 102 and has been located within a predetermined position at which fluid treatment is desired to be a delivered to the formation 100, the sealing member 205A is disposed in sealing engagement with the wellbore string 11 (such as, for example, sealing engagement with the flow control member 16 that is local to a selected treatment material interval), and thus, in effect, renders the sealing member 205A in the sealing engagement condition. The setting and unsetting of the sealing member 205A is effected by compression between a gauge ring 205E and a setting cone 205D, in response to a force applied to the workstring 300 in a downhole direction when mechanical slips 205B have been set, as is further explained below.

Figure 8:
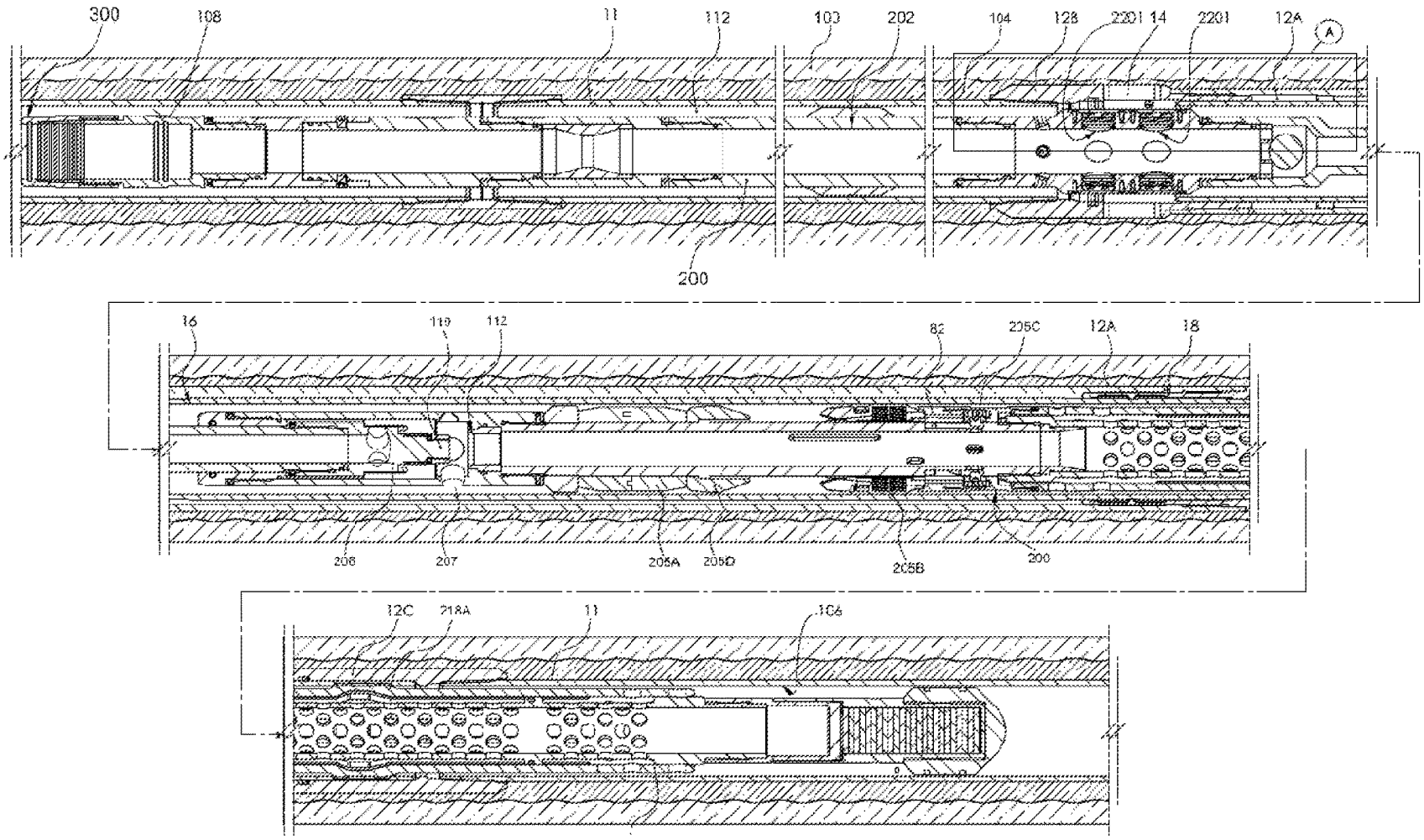
FIG. 8 is a side sectional view of the system shown in FIG. 5, illustrating the bottomhole assembly having displaced the flow control member from the open position in FIG. 7 to a closed position, after completion of fluid treatment, and after the equalization valve has been moved uphole to effect pressure equalization.
Figure 8A:
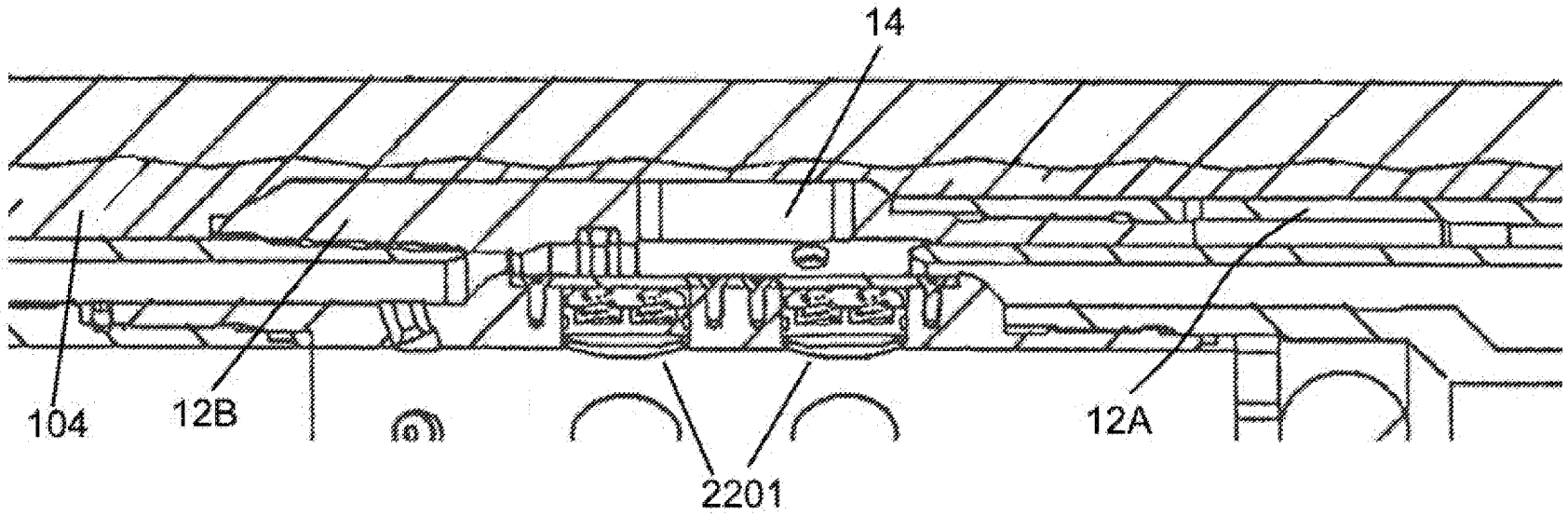
FIG. 8A is an enlarged view of detail "A" of FIG. 8.

An equalization valve 206 is provided for at least interfering with (and, in some embodiments, for example, sealing or substantially sealing) fluid communication, through the fluid passage 2021, via fluid conductor ports 207 extending through the fluid conductor 202, between: (i) an uphole portion 108 of the annular region 112 that is disposed uphole relative to the annular sealing member 204, and (ii) a downhole wellbore portion 106 that is disposed downhole relative to the annular sealing member 204, while the annular sealing member 204 is sealingly, or substantially sealingly, engaging the wellbore string 11. The uphole portion 108 is a portion of the annular region 112 that is disposed uphole of the sealing member 204 while the sealing member is sealingly, or substantially sealingly, engaging the wellbore string 11. In this respect, while the annular sealing member 204 is sealingly, or substantially sealingly, engaging the wellbore string 11, the equalization valve is disposable between at least:

(a) a downhole isolation condition, wherein fluid communication, through the fluid passage 2021, via the fluid conductor ports 207, between the uphole annular region portion 108 and the downhole wellbore portion 106, is sealed or substantially sealed (see FIGS. 5, 6 and 7), and (b) a depressurization condition, wherein the uphole annular region portion 108 is disposed in fluid communication, through the fluid passage 2021, via the fluid conductor ports 207, with the downhole wellbore portion 106 (see FIG. 8).

The equalization valve 206 includes a valve plug 210 and a valve seat 212. The valve plug 210 is connected to the workstring 300 via a pull tube 214. In this respect, the valve plug 206 is displaceable, relative to the valve seat 212, in response to forces translated by the pull tube 214, that are being applied to the workstring 300, between a downhole isolation position, corresponding to disposition of the equalization valve 206 in the downhole isolation condition, and a depressurization position, corresponding to disposition of the equalization valve 206 in the depressurization condition. The valve seat 212 is connected to the sealing mandrel 208 (see below).

The valve plug 210 is configured for sealingly engaging the valve seat 212. While the equalization valve 206 is disposed in the downhole isolation condition, the valve plug 210 is disposed in the downhole isolation position such that the valve plug 210 is disposed in sealing engagement with the valve seat 212. While the equalization valve 206 is disposed in the depressurization condition, the valve plug 210 is disposed in the depressurization position such that the valve plug 210 is spaced apart from the valve seat 212.

Displacement of the valve plug 210 from the downhole isolation position to the depressurization position is in a direction that is uphole relative to the valve seat 212. Such displacement is effected by application of a tensile force to the workstring 300, resulting in translation of such force to the valve plug 210 by the pull tube 214. Uphole displacement of the valve plug 210, relative to the valve seat 212, is limited by a detent surface (or "hard stop") 211 that is integral with the structure that forms the valve seat 212 (and is part of the equalization valve 206). In this respect, the valve plug 210 includes a shoulder surface, and the limiting of the uphole displacement of the valve plug 210, relative to the valve seat 212, is effected upon contact engagement between the shoulder surface and the stop 211.

A check valve 222 is provided within the fluid passage 2021, uphole of the valve seat 212. The check valve 222 seals fluid communication between an uphole portion 2021A of the fluid passage 2021 and the uphole annular region portion 108 (via the fluid conductor ports 207) by sealingly engaging a valve seat 2221, and is configured to become unseated, to thereby effect fluid communication between the uphole annular region portion 108 and the uphole portion 2021A, in response to fluid pressure within the uphole annular region portion 108 exceeding fluid pressure within the uphole portion 2021A. In this respect, the check valve 222 permits material to be conducted through the fluid passage 2021 in an uphole direction, but not in an downhole direction. In some implementations, for example, the material being supplied downhole through the annular region 112 includes fluid for effecting reverse circulation (in which case, the equalization valve 206 is also closed), for purposes of removing debris from the annular region 112, such as after a "screen out", and the check valve permits such reverse circulation. In some embodiment, for example, the check valve 222 is in the form of a ball that is retained within a fluid passage portion of the fluid passage 2021, uphole relative to the valve seat 212, by a retainer 2223.

While the annular sealing member 204 is disposed in the sealing engagement condition, and while the valve plug 210 is disposed in the downhole isolation position, and while the flow control member 16 is disposed in the open position (see FIG. 7), treatment material may be supplied downhole and directed to the flow control apparatus port 14 (and through the flow control apparatus port 14 to the treatment interval) through the uphole annular region portion 108 of the wellbore string passage 2). Without the valve plug 210 effecting the sealing of fluid communication, through the fluid passage 2021, between the uphole annular region portion 108 and the downhole wellbore portion 106, at least some of the supplied treatment material may bypass the flow control apparatus port 14 and be conducted further downhole from the flow control apparatus port 14 via fluid conductor ports 207 to the downhole wellbore portion 106. Also, the check valve 222 prevents, or substantially prevents, fluid communication of treatment material, being supplied downhole through the uphole annular region portion 108, with the uphole fluid passage portion 2021A, thereby also mitigating losses of treatment material uphole via the fluid passage 2021.

Alternatively, using other embodiments of the bottomhole assembly 200, the treatment material may be supplied downhole via coiled tubing, and through a fluid passage defined within the bottomhole assembly 200 to effect treatment of the treatment interval via the flow control apparatus port 14.

The sealing mandrel 208 is connected to the valve seat 212, and is thereby configured for receiving forces translated by the valve plug 210 (such as, for example, tensile or compressive forces applied to the workstring 300) to the valve seat 212. The sealing mandrel 208 is configured to receive compressive forces translated to the valve seat 212 by the valve plug 210 (and as applied to the workstring 300) when the valve plug 210 has reached the downhole limit of its extent of travel relative to the valve seat 212 (i.e. the valve plug 210 is sealingly engaging the valve seat 212). The sealing mandrel 208 is also configured to receive tensile forces in response to pulling up on the workstring 300, which is translated to the valve seat 212 by virtue of the contact engagement between the shoulder surface of the valve plug 210 and the detent surface 211 that is connected to the valve seat 212.

Figure 10:
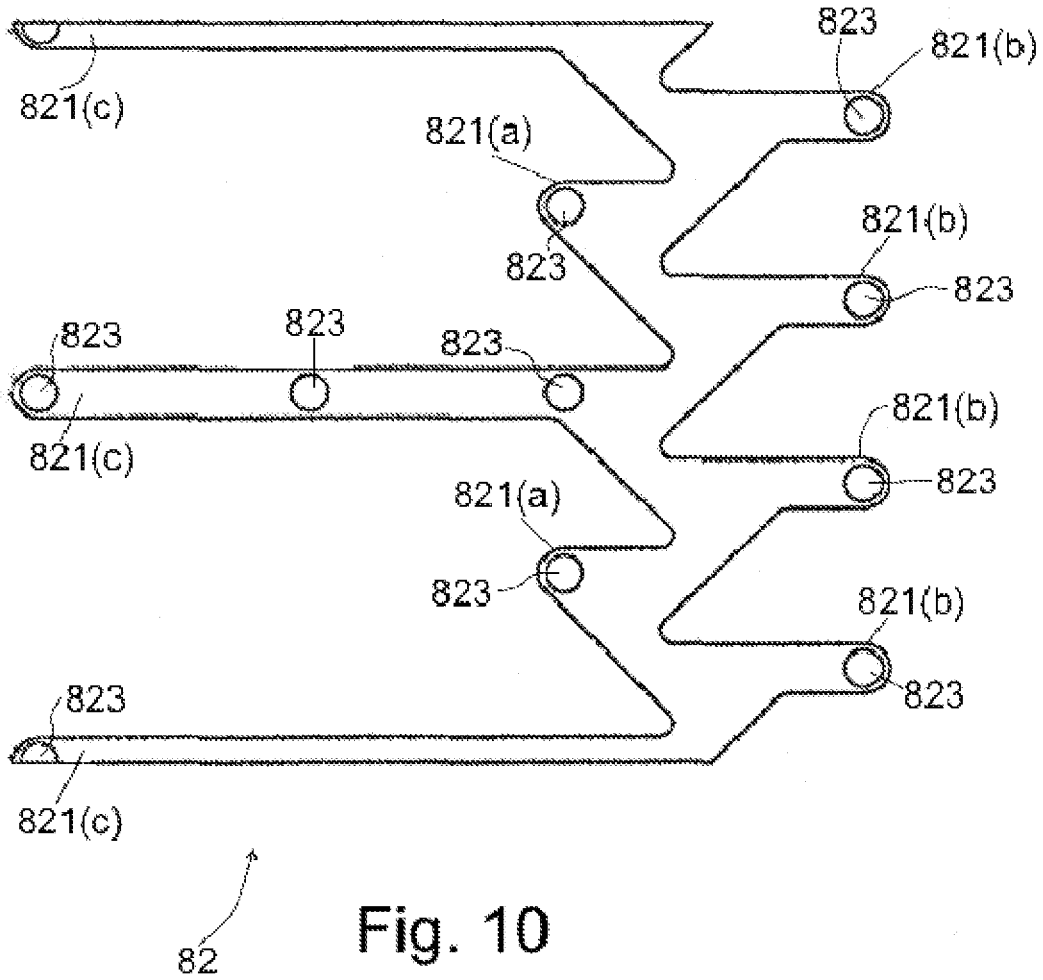
FIG. 10 is a schematic illustration of a j-slot of the bottomhole assembly illustrated in FIGS. 5 to 8.

Referring to FIG. 10, a J-slot 82 is formed within the sealing mandrel 208. A cam actuator or pin 205C, is disposed for travel within the J-slot. The pin 205C is coupled to the locating mandrel 216 such that coupling of the locating mandrel 216 to the sealing mandrel 208 is effected by the disposition of the pin 205C within the j-slot 82, and the coupling of the locating mandrel 216 to the sealing mandrel 208 is such that relative displacement between the locating mandrel 216 and the sealing mandrel 208 is guided by interaction between the pin 205C and the j-slot 82. The pin 205C is positionable at various positions within the j-slot 82. Pin position 821(*a*) corresponds to a run-in-hole (("RIH") mode of the bottomhole assembly 200. Pin position 821(*b*) corresponds to a pull-out-of-hole (("POOH") mode of the bottomhole assembly 200. Pin position 821(*c*) corresponds to the set mode of the bottomhole assembly 200, wherein the packer is disposed in the set condition. Debris relief apertures 823 may be provided at various positions within the J-slot 82 to permit discharge of settled solids as the pin slides within the J-slot 82.

In some embodiments, for example, the sealing mandrel 208 further includes a bullnose centralizer 2141 for centralizing the bottomhole assembly 200.

In some embodiments, for example, the bottomhole assembly 200 includes a locating mandrel 216. The locating mandrel 216 is slidably disposed over the sealing mandrel 208. The locating mandrel 216 includes a locator 218 for effecting desired positioning of the bottomhole assembly relative to the wellbore string 11. The locator 218 extends outwardly, relative to the sealing mandrel 208, and is configured to engage a corresponding recess 111 within the wellbore string 11. When disposed within the recess 111, the locator 218 resists movement of the downhole assembly tool 200 relative to the wellbore string 11. In this respect, the locator 218 is sufficiently resilient such that, when the bottomhole assembly 200 is positioned within the wellbore string 11, such that the locator 218 is disposed other than in alignment with the recess 111, the locator 218 is disposed in a retracted position, permitting travel of the bottomhole assembly 200 through the casing passage, but still exerting some drag force against the wellbore string 11 and, in this way, opposing the travel of the downhole tool assmebly 200 through the wellbore. When the locator 218 becomes positioned in alignment with the recess 111, the resiliency of the locator 218 urges the locator into disposition within the recess 111, thereby "locating" the bottomhole assembly 200.

As mentioned above, the locating mandrel 216 further includes one or more pins 205C, held in place against the sealing mandrel 208, such that the one or more pins 205C are disposed within the J-slot 82. The pin 205C is a coupled to the locating mandrel 216 such that coupling of the locating mandrel 216 to the sealing mandrel 208 is effected by the disposition of the pin 205C within the J-slot 82, and the coupling of the locating mandrel 216 to the sealing mandrel 208 is such that relative displacement between the locating mandrel 216 and the sealing mandrel 208 is effected and guided by interaction between the pin 205C and the J-slot 82.

Actuatable mechanical slips 205B may be positioned relative to the locating mandrel 216 for translating axially with the locating mandrel. The mechanical slips 205B are configured, upon actuation, to engage the wellbore string 11 such that, while the mechanical slips 205B are engaged to the wellbore string 11, the mechanical slips 205B are gripping (or, in some embodiments, for example, biting) into the wellbore string 11, thereby resisting axial displacement of the locating mandrel 216 relative to the wellbore string 11.

The sealing mandrel 208 and the locating mandrel 216 are co-operatively configured to effect actuation of the sealing member 205A in response to application of a force, in a downhole direction, applied to the workstring 300. When the valve plug 210 is seated against the valve seat 212, the forces applied to the workstring 300 are translated to the sealing mandrel 108. Due to resistance provided by the locator 218 (for example, while disposed within the recess 111) to displacement of the locator 218 relative to the casing, continued application of a compressive forces to the workstring 300 (which does not overcome the interference being effected by the locator 218) drives the setting cone 205D against the mechanical slips 205B, and the mechanical slips are forced outwardly into engagement with the wellbore string 11. The mechanical slips 205B are now gripping (or "biting into") the wellbore string 11. While the mechanical slips 205B are gripping (or biting into) the wellbore string 11, and thereby preventing axial displacement of the packer 205, application of a compressive force (a sealing member actuation force that is less than a valve opening force) to the workstring 300 translates to the gauge ring 205E such that the sealing member 205A is pressed against the setting cone 205D (whose displacement is being resisted by the mechanical slips), resulting in deformation of the sealing member 205A in an outwardly direction, thereby compressing the sealing member 205A and urging the sealing member 205A into sealing engagement with the wellbore string 11. The packer is now in the set condition.

In some embodiments, for example, the locator 218 and the recess 111 are co-operatively configured such that displacement of the locator 218 from the recess 111, with effect that the bottomhole assembly 200 becomes disposed for movement relative to the wellbore string 11, is effected by a second displacement force, wherein the second displacement force is greater than a minimum second displacement force. Likewise, the resilient retainer member 18 and one or more of the recesses 30 and 32 are co-operatively configured such that displacement of the resilient retainer member 18 from the corresponding recess 30 or 32, with effect that the flow control member 16 becomes disposed for displacement relative to the flow control appartus port 14, is effected by a first displacement force, wherein the first displacement force is greater than a minimum first displacement force. The first displacement force may range from 3,000 lbs to 7,000 lbs. The second displacement force may range from 1,500 to 2,500 lbs. In order to mitigate the risk of inadvertently closing an open treatment port 14 by closing of the flow control member 16 by a shifting tool, the minimum first displacement force is selected to be greater than the minimum second displacement force by at least 500 lbs, such as, for example, at least 1000 lbs.

The shifting tool is for effecting movement of the flow control member 16 between the open position and the closed position, including its displacement from the recesses 30 and 32. In some embodiments, for example, the shifting tool includes a first shifting tool 220A for effecting opening of the flow control member 16, and also includes a second shifting tool 220B for effecting closing of the flow control member 16.

In some embodiments, for example, the shifting tool includes the packer 205. In such embodiments, for example, the packer 205 engages the flow control member 16, while the packer 205 is in the set condition, with effect that the packer 205 is coupled to the flow control member 16. In this respect, the setting of the packer 205 effects coupling of the shifting tool to the flow control member 16. The coupling is with effect that, while sufficient force (the opening force) is being applied to the packer 205 to overcome the resistance being provided by the resilient retainer member 18 (such force, for example, can be applied hydraulically, mechanically (such as by the workstring), or a combination thereof), the force is translated by the packer 205 and applied to the flow control member 16, resulting in displacement of the flow control member 16 from one of the open and closed positions to the other one of the open and closed positions. In this respect, the engagement of the packer 205 to the flow control member 16 is effected by the setting of the packer 205. In those embodiments where first and second shifting tools 220A, 220B are provided, the first shifting tool 220A includes the packer 205.

In those embodiments including first and second shifting tools 220A, 220B, in some of these embodiments, for example, the second shifting tool 220B includes one or more hydraulic hold down buttons 2201. In some embodiments, for example, the one or more hydraulic hold down buttons 2201 are disposed uphole relative to the equalization valve 206 and mounted to the fluid conductor 202. The one or more hydraulic hold down buttons 2201 are configured to be actuated (see FIG. 9) for exerting a sufficient gripping force against the flow control member 16 (in this case, the sleeve 16A), while the flow control member 16 is disposed in the closed position, such that, while the flow control member 16 is disposed in the closed position, and while the hydraulic hold down buttons 2201 are actuated, and while a tensile force is being applied by the workstring 300 to the fluid conductor 202, displacement of the flow control member 16 from the open position to the closed position is effected. The one or more hydraulic hold down buttons 2201 are actuated when the pressure within fluid passage 2021 exceeds the pressure within the annular region 112 108. In some embodiments, for example, the fluid pressure differential may be established by supplying pressurized fluid through the fluid passage 2021 from a source at the surface.

In some embodiments, for example, the bottomhole assembly 200 further includes the perforating device 224. The perforating device 224 is disposed in fluid communication with the fluid passage 2021 for receiving fluid perforating agent from surface via the fluid passage 2021 and jetting the received fluid perforating agent (through the nozzles 226 of the perforating device 224) against the wellbore string 11 for effecting perforation of the portion of the wellbore string 11 adjacent to the nozzles 226. The fluid perforating agent includes an abrasive fluid. In some of these embodiments, for example, the abrasive fluid includes a carrier fluid and an abrasive agent, and the abrasive agent includes sand. In some embodiments, for example, the carrier fluids includes one or more of: water, hydrocarbon-based fluids, propane, carbon dioxide, and nitrogen assisted water. It is understood that use of the perforating device to effect perforating, in this context, is generally limited to upset conditions where the flow control member 16 is unable to be moved by the shifting tool from the closed position to the open position. In those circumstances, perforation may be necessary in order to effect supply of treatment material to the treatment material interval in the vicinity of the selected flow control apparatus port 14. While the fluid perforating agent is being supplied through fluid passage 2021, the check valve 222 is urged to a closed condition, thereby forcing the supplied fluid perforating agent to be conducted through the nozzles 226.

In some embodiments, for example, the perforating device 224 is disposed uphole relative to the one or more hydraulic hold down buttons 2201, and provides the additional functionality of enabling their actuation through the jetting of fluid through one or more of its nozzles 226, as is explained further below. While fluid is being supplied via the fluid passage 2021, the check valve 222 is urged to a closed condition, thereby forcing the supplied fluid to be directed through the nozzles 226, and thereby effecting the actuation of the hydraulic hold down buttons 2201.

In combination with enabling actuation of the hydraulic hold down buttons 2201, the jetting of fluid through its nozzles 226 may also perform a "washing" or "flushing" function (and thereby functions as a "washing sub"), in that at least a fraction of solid material disposed in the vicinity of the flow control apparatus port 14 is fluidized, carried, or swept away, by the injected fluid remotely from the flow control apparatus port 14. While the flow control member 16 is disposed in the open position, solid material in the vicinity of the flow control apparatus port 14 may interfere with displacement of the flow control member 16 from the open position to the closed position. Solid material that may be present in the vicinity of the flow control apparatus port includes sand which has migrated in through the flow control apparatus port 14 from the formation 100 during supplying of the treatment material through the flow control apparatus port 14, or after the supplying has been suspended. The solid material can include proppant which is remaining within the wellbore. By removing such solid material from the vicinity of the flow control apparatus port, prior to, or while, moving of the flow control member 16 to the closed position, interference to such closure may be mitigated.

In this respect, the nozzles 226 are configured to inject fluid into the wellbore 102, and positioned relative to the hydraulic hold down buttons 2201, such that, while the apparatus 10 is positioned within the wellbore 102 such that, upon the actuation of the shifting tool (e.g. the hydraulic hold down buttons 2201), the engagement between the shifting tool and the flow control member 16 is being effected, and while the flow control member 16 is disposed in the open position, the nozzles 226 are disposed for directing injected fluid towards the path along which the flow control member 16 is disposed for travelling as the flow control member 16 is displaced from the open position to the closed position.

In some embodiments, for example, the nozzles 226 are further co-operatively positioned relative to the hydraulic hold down buttons 2201 such that, while the flow control member 16 is disposed in the open position, and the nozzles 226 are jetting fluid to actuate the hydraulic hold down buttons 2201 (see below) and clearing solid debris from the port 14, the nozzles are directed such that the fluid is jetted in a direction that is not in alignment with sealing members that are exposed within the passage 13 (e.g. sealing member 121B or sealing member 121C) so as to avoid damaging or displacing the sealing member (such as by displacing the sealing member from the cavity within which it is disposed)

In some embodiments, for example, independently of any perforating device 224, a washing sub may be provided to effect the washing/flushing function that is described above. In some embodiments, for example, the washing sub is configured to discharge or jet fluid characterized by a flowrate of between 20 and 1,500 liters per minute and at a pressure differential of between 20 and 200 pounds per square inch.

The following describes an exemplary deployment of the bottomhole assembly 200 within a wellbore 102 within which the above-described apparatus is disposed, and subsequent supply of treatment material to a zone of the subterranean formation 100.

The bottomhole assembly 200 is run downhole through the wellbore string passage 2, past a predetermined position (based on the length of workstring that has been run downhole). The j-slot 208 is configured such that, while the assembly 200 is being run downhole, displacement of the sealing mandrel 208 relative to the locating mandrel 216 is limited such that the setting cone 205D is maintained in spaced apart relationship relative to the mechanical slips 205B, such that the mechanical slips 205B are not actuated during this operation. In this respect, while the bottomhole assembly is being run downhole through the wellbore string passage 2, the pin 205C is positioned in pin position 823(*a*) within the j-slot 82. Once past the desired location, a tensile force is applied to the workstring, and the predetermined position, at which the selected flow control apparatus port is located, is located with the locator 218. The workstring 300 becomes properly located when the locator 218 becomes disposed within a locating recess 111 within the wellbore string 11. In this respect, the locator 218 and the locating recess 111 are co-operatively profiled such that the locator 218 is configured for disposition within and engagement to the locating recess 111 when the locator 218 is moving past the locating recess 111. Successful locating of the locator 218 within the locating recess 111 is confirmed when resistance is sensed in response to upward pulling on the workstring 300. During the pulling up on the workstring, the pin 205C is displaced to pin position 821(*b*) within the j-slot 82.

Figure 5:
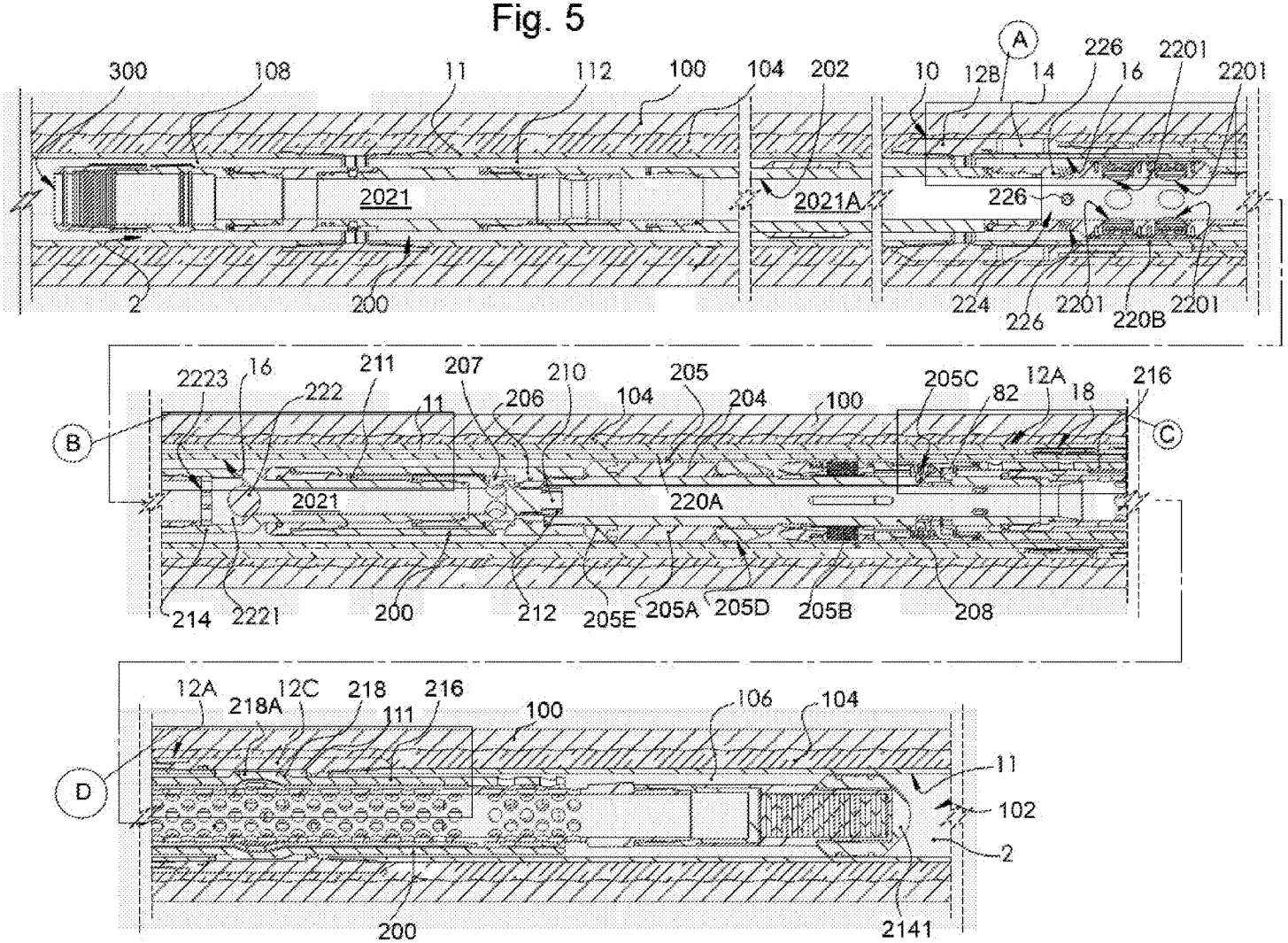
FIG. 5 is a side sectional view of an embodiment of a system of the present disclosure, incorporating the flow control apparatus of FIG. 1 within a wellbore string disposed within a wellbore, and illustrating a bottomhole assembly having been located within a pre-selected position within the wellbore, with the flow control member disposed in the closed position, and with the equalization valve disposed in the downhole isolation condition, but prior to setting of the packer and its engagement to the flow control member.
Figure 5A:
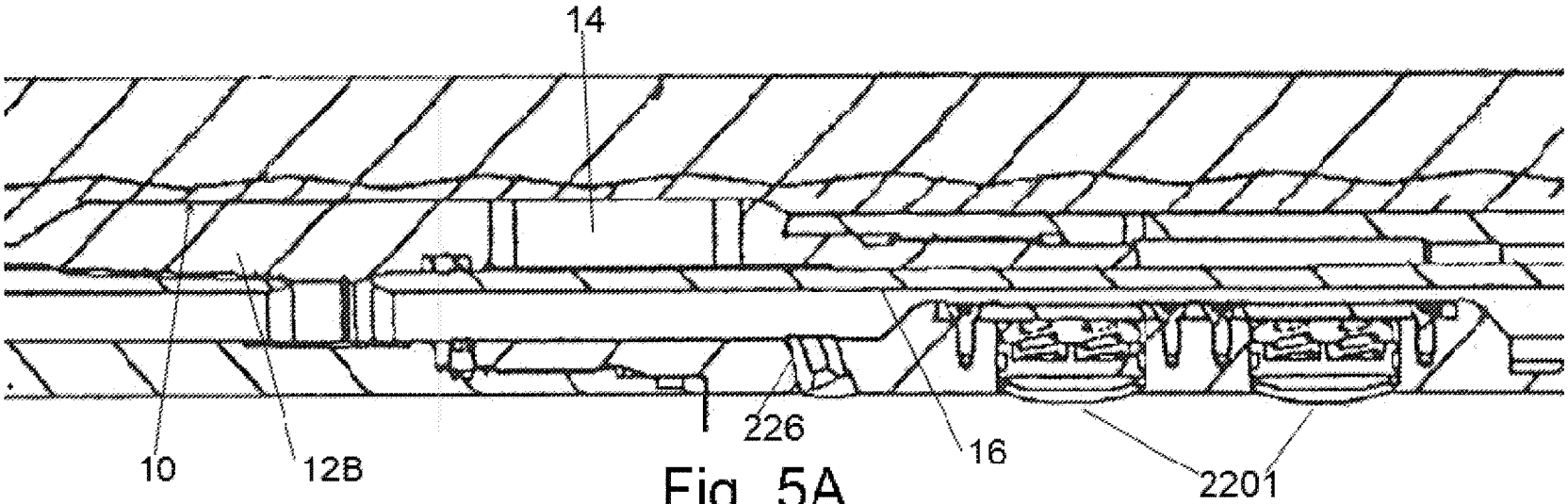
FIGS. 5A-5D are enlarged view of details "A," "B," "C," and "D" of FIG. 5, respectively.
Figure 5B:
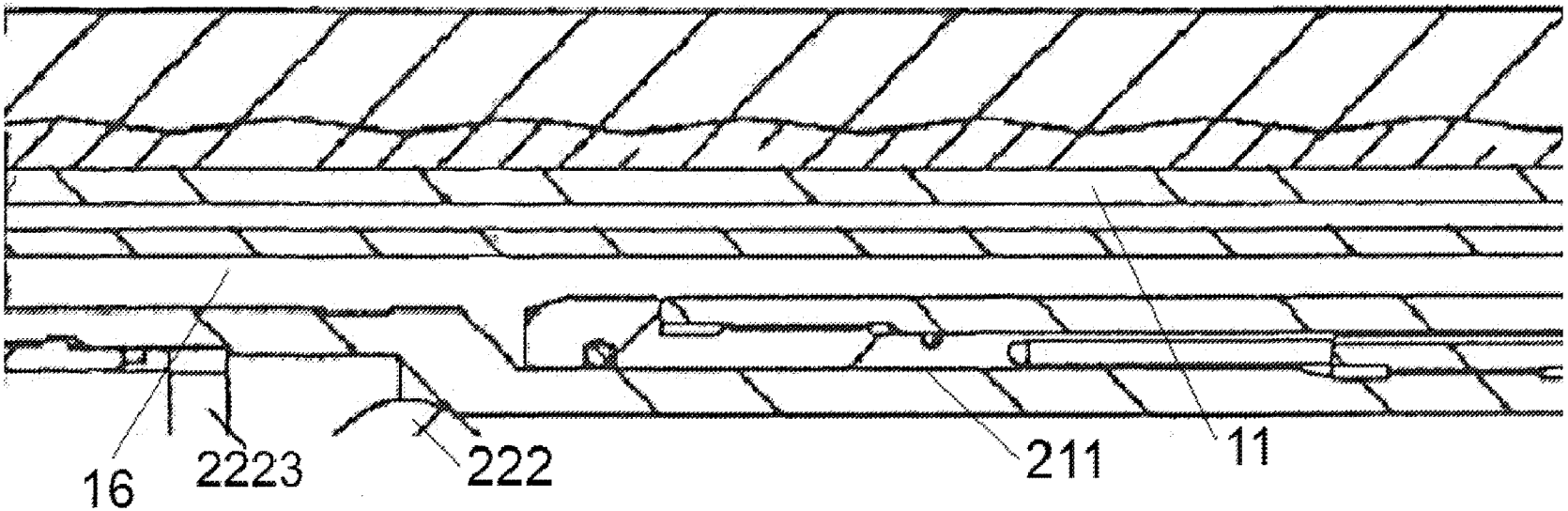
Figure 5C:
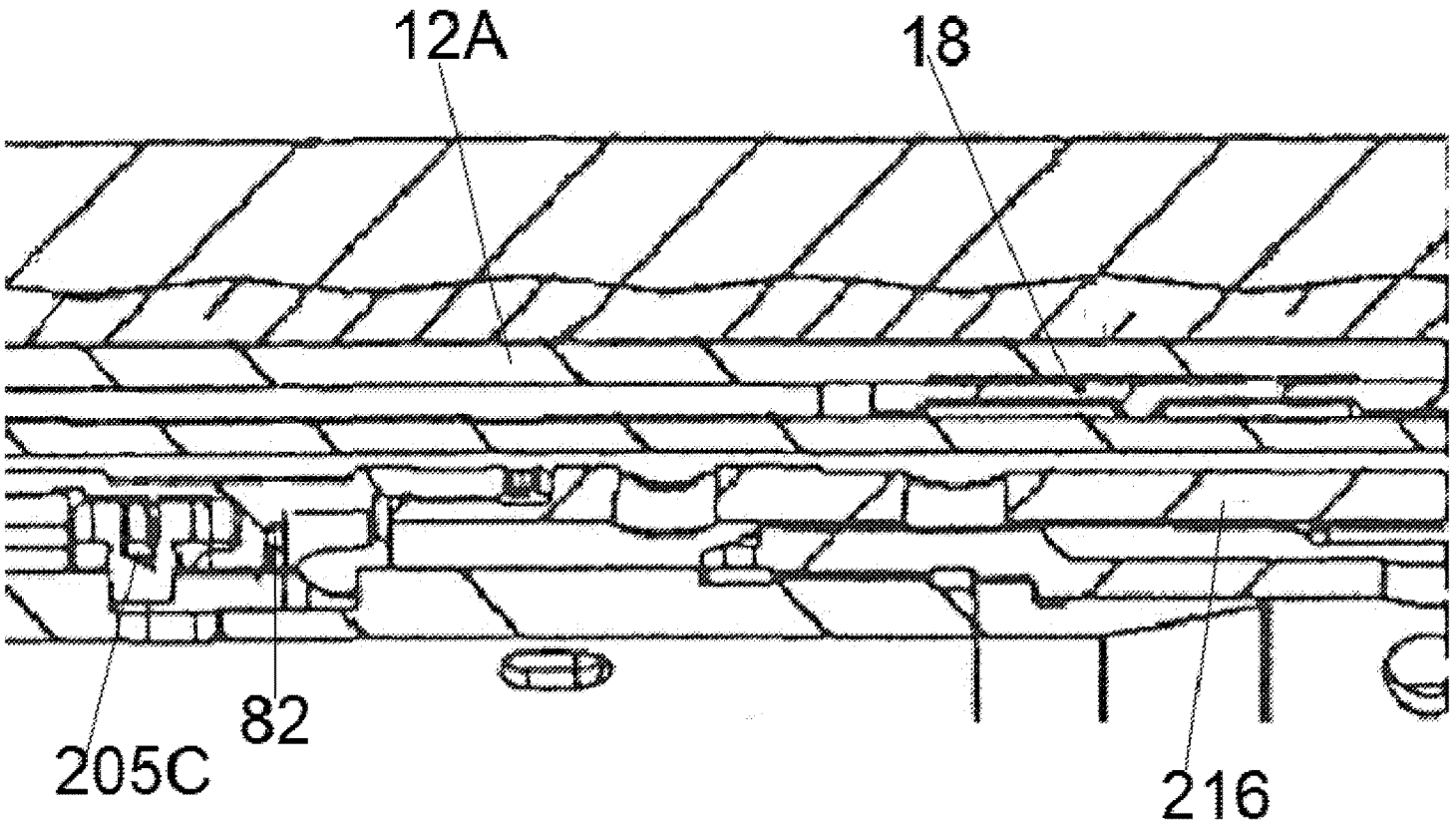
Figure 5D:
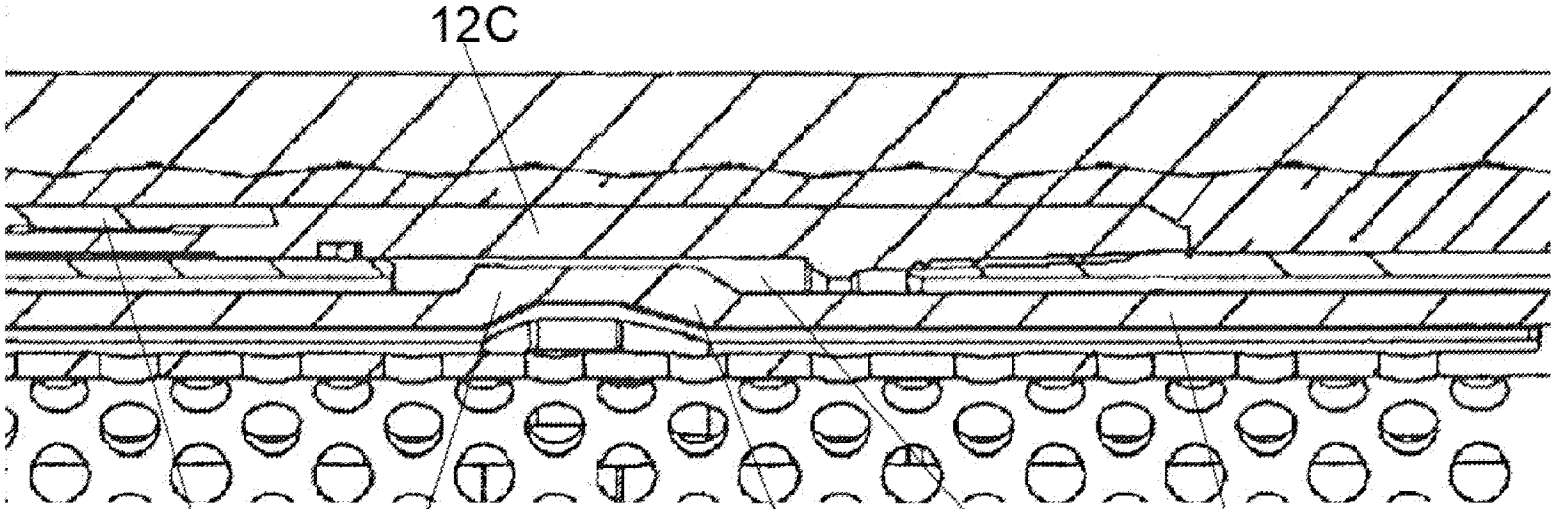

Once disposed in the pre-determined position, the workstring 300, and after pulling up on the workstring 300 to confirm the positioning, the workstring 300 is forced downwardly, and the applied force is translated such that sealing engagement of the valve plug 210 with the valve seat 212 is effected (see FIG. 5). Further compression of the workstring 300 results in actuation of the mechanical slips 205B, effecting setting of the packer 205 (as the sealing mandrel 208 receives the compressive forces imparted by the workstring 300), for effecting engagement of the resilient sealing member 205A to the flow control member 16, such that both gripping and sealing engagement of the flow control member 16 is effected by the sealing member 205A (see FIG. 6). While the workstring 300 continues to be further compressed, shearing of the one or more pins 40 is effected, the one or more tabs 18B become displaced out of the closed position-defining recess 30 of the flow control member 16 (such as by deflection of the tabs 18B), and, in parallel, the locator 218 is displaced from the locating recess, and the flow control member 16 is displaced from the closed position to the open position (by virtue of the gripping of the flow control member 16 by the packer 205 and the slips 205B), thereby effecting opening of the flow control apparatus port 14 and enabling supply of treatment material to the subterranean formation 100 that is local to the flow control apparatus port 14 (see FIG. 7). Upon the flow control member 16 being displaced into the open position, the one or more tabs 18B become disposed within the open position-defining recess 32 of the flow control member 16, thereby resisting return of the flow control member 16 to the closed position. During this operation, the pin 205C is displaced to the pin position 821(*c*) within the j-slot 82.

Treatment material may then be supplied via the annular region 112 defined between the bottomhole assembly 200 and the wellbore string 11 to the open flow control apparatus port 14, effecting treatment of the subterranean formation 100 that is local to the flow control apparatus port 14. The packer 205, in combination with the sealing engagement of the valve plug 210 with the valve seat 212, prevents, or substantially prevents, the supplied treatment material from being conducted downhole, with effect that all, or substantially all, of the supplied treatment material, being conducted via the annular region 112, is directed to the formation 100 through the open flow control apparatus port 14.

After sufficient treatment material has been supplied to the subterranean formation 100, supplying of the treatment material is suspended.

In some implementations, for example, after the supplying of the treatment material has been suspended, the valve closing member 16 may be returned to the closed position.

In that case, in some of these implementations, for example, prior to effecting displacement of the valve closing member 16 from the open position to the closed position, it may be desirable to unset the packer 205 and use a second shifting tool 220B for effecting the displacement of the flow control member 16 from the open position to the closed position.

In this respect, after the delivery of the treatment material to the formation 100 has been completed, a fluid pressure differential exists across the actuated packer 205 (which is disposed in sealing engagement with the flow control member 16), owing to the disposition of the equalization valve 206 in the downhole isolation condition, and the fluid pressure differential may be reduced or eliminated by retraction of the valve plug 201 from the valve seat 212.

When disposed in the downhole isolation condition, the equalization valve 206 prevents, or substantially prevents, draining of fluid that remains disposed uphole of the packer 205. Such remaining fluid may provide sufficient interference to movement of the flow control member 16 from the open position to the closed position, such that it is desirable to reduce or eliminate the fluid remaining within the annular region 112 and the formation, and thereby reduce or eliminate the pressure differential that has been created across the packer 205, prior to effecting the displacement of the flow control member 16 from the open position to the closed position. In some of these implementations, for example, the reduction or elimination of this pressure differential is effected by retraction of the valve plug 210 from the valve seat 212, to thereby effect draining of fluid, remaining uphole of the packer 205, downhole through the fluid passage 2021. The retraction of the valve plug 210 from the valve seat 212 is effected by a tensile force exerted by the workstring 300. In parallel, the pin 205C is displaced within the j-slot 82 to the pin position 821(*b*).

Once the valve plug 210 has been retracted from the valve seat 212, tensile force continues to be applied on the workstring 300 such that the valve plug 210 becomes disposed against the detent surface 211. After the valve plug 210 has become disposed against the detent surface 211, and thereby prevented from further moving in the uphole direction, tensile force continues to be applied to the workstring 300. Such force effects retraction of the cone from the slips 205B, thereby permitting retraction of the mechanical slips 205B from the wellbore string 11. Simultaneously, because the force effecting pressing of the sealing member 205A against the setting cone has been released, the packer 205 becomes unset.

Because the packer 205 has been unset, the packer 205 is no longer functional for effecting displacement of the flow control member 16. In this respect, in these embodiments, a second shifting tool is provided for effecting this displacement. As alluded to above, the second shifting tool may include hydraulic hold down buttons 2201.

The hydraulic hold down buttons 2201 may be actuated for gripping (or "biting into") the flow control member 16 with effect that tensile forces imparted to the hydraulic hold down buttons 2201, via the workstring 200, may be translated as the closing force to the flow control member 16 by the hydraulic hold down buttons 2201. Actuation of the hydraulic hold down buttons 220 is effected by supplying fluid (for example, such as water) downhole through the fluid passage 204. As described above, their actuation may be enabled through the jetting of fluid through one or more of the nozzles 226 of the perforating device 224. By virtue of the flow of the fluid through the nozzles 226, a pressure differential is created across the perforating device 226, and this fluid pressure differential actuates the hydraulic hold down buttons 2201.

Figure 9:
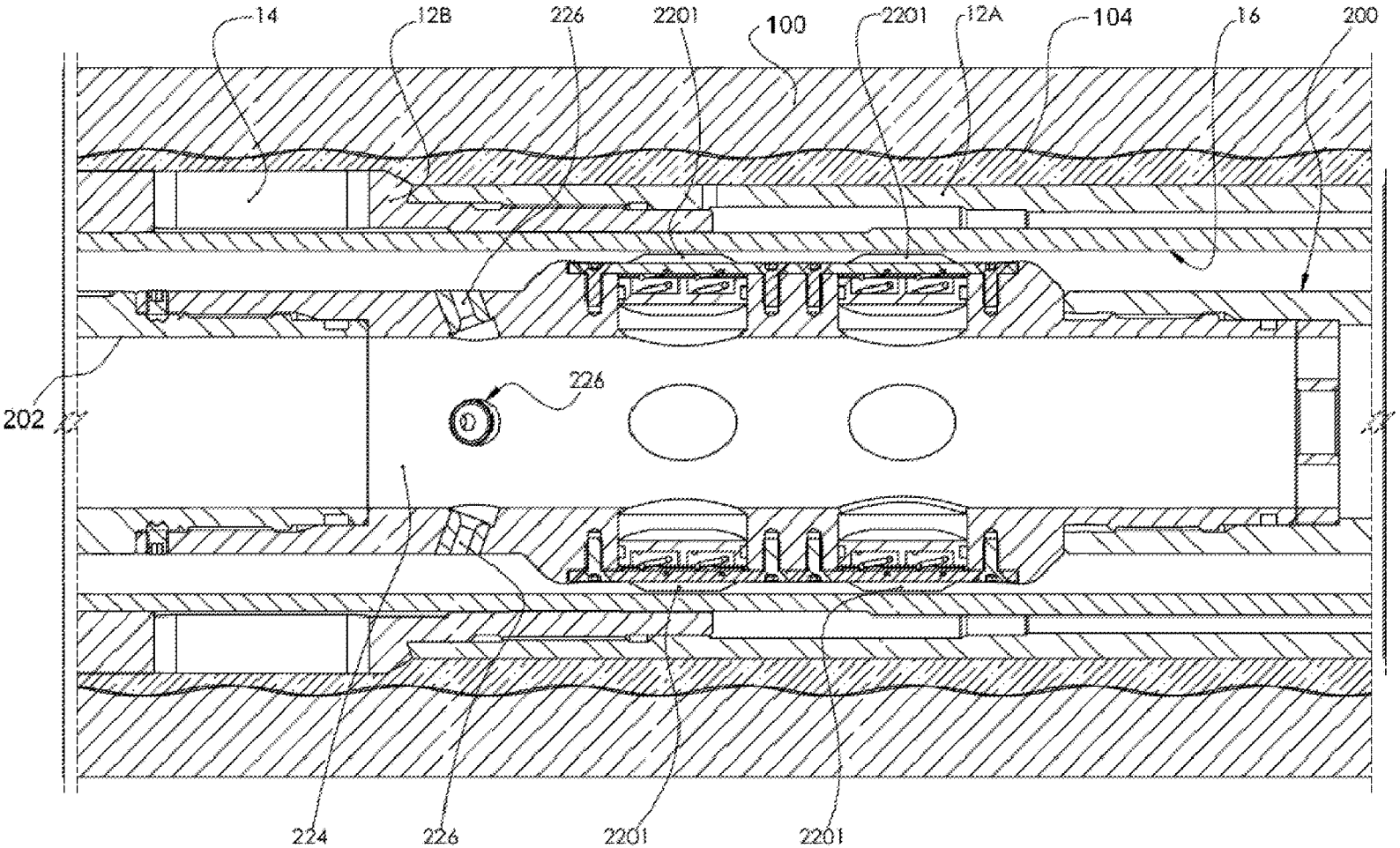
FIG. 9 is a detailed side sectional view of the system shown in FIG. 8, illustrating a portion of the bottomhole assembly with the flow control member having been moved to the closed position by the hydraulic hold down buttons.

Accordingly, after the unsetting of the packer 205, fluid (such as water) is supplied through the fluid passage 204, resulting in a pressure differential being created across the perforating device 224, and thereby effecting actuation of the hydraulic hold down buttons 2201, so that the hydraulic hold down buttons 2201 are gripping (or "biting into") the flow control member 16 (see FIG. 9).

In parallel with the actuation of the hydraulic hold down buttons 2201, the supplied fluid also functions to fluidize or displace solid material from the vicinity of the path along which the flow control member 16 is disposed for travelling as the flow control member 16 moves between the open position and the closed position.

Once the hydraulic hold down buttons 2201 have been actuated, a tensile force is applied to the workstring 30. By virtue of their engagement to the flow control member 16, the hydraulic hold down buttons 2201 translate the tensile force, being applied by the workstring, as a closing force to the flow control member 16, to effect displacement of the finger tab 18B from (or out of) the open position-defining recess 32. After such displacement, continued application of the tensile force effects displacement of the flow control member 16 from the open position to the closed position (see FIG. 8).

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A flow control apparatus comprising:

a housing including a first cross-over sub, an intermediate housing section, and a second cross-over sub;

a port extending through the housing;

a housing passage defined within the housing and configured for fluidly communicating with an environment external to the housing via the port;

a flow control member displaceable relative to the port for effecting opening and closing of the port;

and a resilient retainer member biased for releasably retaining the flow control member relative to the housing;

wherein:

the first cross-over sub is connected to the intermediate housing section;

the second cross-over sub is connected to the intermediate housing section;

the first cross-over sub, the intermediate housing section, and the second cross-over sub are co-operatively configured such that a retainer housing space is disposed between the first and second cross-over subs; and the resilient retainer member extends from one of the first and second cross-over subs and into the retainer housing space, such that the resilient retainer member is disposed between intermediate housing section and the flow control member.

2. The flow control apparatus as claimed in claim 1;

wherein the connection of the first cross-over sub to the intermediate housing section is a threaded connection, and the connection of the second cross-over sub to the intermediate housing section is a threaded connection.

3. The flow control apparatus as claimed in claim 1;

wherein the connection of the first cross-over sub to the intermediate housing section is to a first end of the intermediate housing section, and the connection of the second cross-over sub to the intermediate housing section is to a second end of the intermediate housing section, the second end being at an opposite end relative to the first end.

4. The flow control apparatus as claimed in claim 1;

wherein the first cross-over sub defines an internal passage having a cross-sectional area that is less than the cross-sectional area of the intermediate housing section, and the second cross-over sub defines an internal passage having a cross-sectional area that is less than the cross-sectional area of the intermediate housing section.

5. The flow control apparatus as claimed in claim 1;

wherein the flow control member and the resilient retainer member are co-operatively configured such that the releasable engagement of the resilient member to the flow control member is effected while the flow control member is disposed relative to the port such that the port is disposed in a dosed condition, and is also effected while the flow control member is disposed relative to the port such that the port is disposed in an open condition.

6. The flow control apparatus as claimed in claim 1;

wherein the flow control member and the housing are co-operatively configured such that, while the flow control member is disposed relative to the port such that the port is disposed in the dosed condition, fluid communication between the housing passage and the retainer housing space is sealed or substantially sealed.

7. The flow control apparatus as claimed in claim 1;

wherein the port is defined in one of the first and second cross-over subs.

8. The flow control apparatus as claimed in claim 1;

wherein the port is defined in the other one of the first and second cross-over subs.

9. The flow control apparatus as claimed in claim 1;

wherein the intermediate section is disposed between the first and second cross-over subs.

10. A flow control apparatus comprising:

a housing;

a port extending through the housing;

a housing passage defined within the housing and configured for fluidly communicating with an environment external to the housing via the port;

a flow control member displaceable relative to the port for effecting opening and closing of the port;

a resilient retainer member biased for releasably retaining the flow control member relative to the housing, wherein the resilient retainer member extends from the housing into a retainer housing space such that the resilient retainer member is disposed between the housing and the flow control member; and a vent hole, extending through the housing, for venting the retainer housing space.

11. The flow control apparatus as claimed in claim 10;

wherein the vent hole has a minimum cross-sectional area of greater than 0.1 square inches.

12. The flow control apparatus as claimed in claim 10;

wherein the flow control member and the resilient retainer member are co-operatively configured such that the releasable engagement of the resilient member to the flow control member is effected while the flow control member is disposed relative to the port such that the port is disposed in a dosed condition, and is also effected while the flow control member is disposed relative to the port such that the port is disposed in an open condition.

13. The flow control apparatus as claimed in claim 10;

wherein the flow control member and the housing are co-operatively configured such that, while the flow control member is disposed relative to the port such that the port is disposed in the dosed condition, fluid communication between the housing passage and the retainer housing space is sealed or substantially sealed.

14. The flow control apparatus as claimed in claim 10, further comprising:

a viscous liquid material disposed within the retainer housing space, wherein the viscous liquid material has a viscosity of at least 100 $mm^2/s$ at 40 degrees Celsius.

15. A flow control apparatus, comprising:

a housing;

a port extending through the housing;

a housing passage defined within the housing and configured for fluidly communicating with an environment external to the housing via the port;

a flow control member displaceable relative to the port for effecting opening and closing of the port; and a resilient retainer member biased for releasably retaining the flow control member relative to the housing, wherein the resilient retainer member extends from the housing into a retainer housing space such that the resilient retainer member is disposed between the housing and the flow control member;

wherein the housing and the flow control member are co-operatively configured such that, while the flow control member is disposed relative to the port such that the port is disposed in the closed condition, there is an absence of a sealed interface between the housing and the flow control member for effecting sealing, or substantial sealing, of fluid communication between the port and the retainer housing space.

16. The flow control apparatus as claimed in claim 15;

wherein the absence of a sealed interface between the housing and the flow control member for effecting sealing, or substantial sealing, of fluid communication between the port and the retainer housing space is with effect that a fluid passage is defined between the housing and the flow control member and effecting fluid communication between the port and the retainer housing space, wherein the fluid passage has a maximum cross-sectional area of less than 0.30 square inches.

17. The flow control apparatus as claimed in claim 16;

wherein the housing and the flow control member are closely-spaced relative to one another and are co-operatively configured such that, while the flow control member is disposed relative to the port such that the port is disposed in the closed condition, the fluid passage is effecting fluid communication between the housing passage and the retainer housing space.

18. The flow control apparatus as claimed in claim 15, further comprising:

a viscous liquid material disposed within the retainer housing space, wherein the viscous liquid material has a viscosity of at least 100 $mm^2/s$ at 40 degrees Celsius.

* * * * *